US007634979B2

(12) United States Patent
Adams

(10) Patent No.: US 7,634,979 B2
(45) Date of Patent: Dec. 22, 2009

(54) COMBUSTION-POWERED LINEAR AIR MOTOR/COMPRESSOR

(76) Inventor: Joseph S. Adams, 481 Beaver Point Road, Salt Spring Island, British Columbia (CA) V8K 2J9

( * ) Notice: Subject to any disclaimer, the term of this patent is extended or adjusted under 35 U.S.C. 154(b) by 0 days.

(21) Appl. No.: 11/898,394

(22) Filed: Sep. 12, 2007

(65) Prior Publication Data

US 2008/0115767 A1 May 22, 2008

Related U.S. Application Data

(60) Provisional application No. 60/825,341, filed on Sep. 12, 2006.

(51) Int. Cl.
*F02B 71/00* (2006.01)

(52) U.S. Cl. ..... 123/46 R; 123/46 SC; 60/595

(58) Field of Classification Search ..... 123/46 R, 123/46 A, 46 SC, 66–72; 60/595
See application file for complete search history.

(56) References Cited

U.S. PATENT DOCUMENTS 2,189,497 A * 2/1940 Pateras Pescara ..... 123/46 R
3,722,481 A * 3/1973 Braun ..... 123/46 R
4,365,471 A 12/1982 Adams
4,665,868 A 5/1987 Adams
4,759,318 A 7/1988 Adams
5,377,628 A 1/1995 Adams
5,540,194 A 7/1996 Adams
6,491,002 B1 12/2002 Adams
6,634,325 B1 10/2003 Adams
6,647,969 B1 11/2003 Adams
6,932,031 B2 8/2005 Adams
2003/0110758 A1 6/2003 Adams
2003/0131809 A1 7/2003 Adams

* cited by examiner

*Primary Examiner*—Noah Kamen
(74) *Attorney, Agent, or Firm*—Law Offices of Steven W. Weinrieb

(57) ABSTRACT

A new and improved combustion-powered linear air motor/compressor wherein the new and improved combustion-powered linear air motor/compressor comprises new and improved structure for achieving the scavenging of residual combustion products or exhaust gases from the combustion chamber during the return stroke of the power piston assembly. More particularly, the speed and efficiency of the scavenging of the residual combustion products or exhaust gases is able to be achieved as a result of the power piston assembly causing fresh or ambient air to be rammed or forced into, through, and out of the combustion chamber during its return stroke.

22 Claims, 16 Drawing Sheets

COMBUSTION-POWERED LINEAR AIR MOTOR/COMPRESSOR

CROSS-REFERENCE TO RELATED PATENT APPLICATIONS

This patent application is related to, based upon, and effectively a utility patent application conversion from U.S. Provisional Patent Application Ser. No. 60/825,341 which was filed on Sep. 12, 2006, the priority and filing date benefits of which are hereby claimed.

FIELD OF THE INVENTION

The present invention relates generally to combustion-powered tools, and more particularly to a new and improved combustion-powered linear air motor/compressor for use within combustion-powered tools, such as, for example, combustion-powered fastening driving tools, combustion-powered projectile-firing tools, and the like, wherein the new and improved combustion-powered linear air motor/compressor comprises new and improved structure for achieving the scavenging of residual combustion products or exhaust gases from the combustion chamber during the return stroke of a piston assembly. More particularly, the speed and efficiency of the scavenging of the residual combustion products or exhaust gases is able to be achieved as a result of a scavenging piston of the piston assembly causing fresh or ambient air to be rammed or forced into, through, and out of the combustion chamber during the return stroke of the power piston assembly. In addition, a power piston of the piston assembly may also cause fresh or ambient air to be rammed or forced into, through, and out of the combustion chamber during the power stroke of the power piston.

BACKGROUND OF THE INVENTION

Combustion-powered linear motors are used within combustion-powered tools, such as, for example, tools which are utilized to drive fasteners or other projectiles, wherein the combustion-powered linear motors are intermittently or cyclically operated or actuated, as opposed to being continuously operated as in the case of conventional internal combustion engines, in order to drive or discharge the fasteners or projectiles out from the tools at predetermined times. The combustion-powered linear motors comprise power pistons which undergo power strokes whereby the power pistons cause the fasteners or projectiles to be driven or discharged out from the tools, and subsequently, the combustion chambers of the combustion-powered linear motors need to be scavenged or purged so as to effectively rid the same of residual combustion products or exhaust gases which have been generated during the previous combustion cycle. Failure to properly scavenge or purge the combustion chambers of such residual combustion products or exhaust gases will adversely affect the proper or required stoichiometric ratio of the new or fresh air-fuel mixtures to be charged into the combustion chambers. Accordingly, improper or insufficient power levels will be developed or achieved within the combustion chambers whereby the power pistons will be unable to properly drive or discharge the fasteners or other projectiles out from the combustion-powered tools. In addition, it is also imperative that the aforenoted scavenging or purging of the residual combustion products or exhaust gases be achieved as quickly as possible so as to not only facilitate the rapid operative recycling of the combustion-powered tools, that is, to enable or ready the combustion-powered tools for subsequent firing cycles, but in addition, to effectively prevent the overheating of the combustion-powered tools.

An example of an intermittently operated combustion powered linear motor, and a scavenging system therefor, is disclosed within U.S. Pat. No. 6,932,031 which issued to Adams on Aug. 23, 2003. As can be appreciated from FIG. 1, which substantially corresponds to FIG. 1 of the aforenoted Adams patent, the aforenoted patented system comprises a combustion chamber 2 within which there is disposed a spark plug 6. A power piston 8 is disposed within a piston cylinder, and a return spring 30 is also disposed within the piston cylinder so as to be interposed between the undersurface portion of the power piston 8 and the lower or bottom wall portion of the piston cylinder whereby the return spring 30 serves to return the power piston 8 to its original start position upon completion of its power stroke as a result of the ignition of the air/fuel mixture within the combustion chamber 2. The region of the piston cylinder, which is disposed beneath the power piston 8, is fluidically connected to the lower end portion of a plenum chamber 4 through means of a first check valve 12, and the upper end portion of the plenum chamber 4 is fluidically connected to the combustion chamber 2 through means of a second check valve 24. Still further, a third check valve 17 is provided within the lower end portion of the piston cylinder so as to permit fresh or ambient air to enter the lower end portion of the piston cylinder, and the combustion chamber 2 is provided with an exhaust valve 16 to which a piston-type actuator 14 is operatively connected. In addition, a fluid signal line 13 fluidically interconnects plenum chamber 4 with the piston cylinder within which the piston-type actuator 14 is disposed.

It can therefore be readily appreciated that during the downward movement or power stroke of the power piston 8, fresh or ambient air, which has been previously been admitted into the lower end portion of the piston cylinder through means of the third check valve 17, will be compressed and forced into the plenum chamber 4. In addition, the compressed air will also be conducted through the fluid signal line 13 so as to enter the piston cylinder within which the piston-type actuator 14 is disposed, however, during the early part of the combustion cycle, the pressure developed within the combustion chamber 2 is greater than the pressure of the compressed air within plenum chamber 4 such that the second check valve 24 and exhaust valve 16 remain closed. However, when the power piston 8 nears, approaches, and is substantially at, the end of its downward movement or power stroke, at which time the pressure prevailing within the combustion chamber 2 will have decreased, both the exhaust valve 16 and the second check valve 24 will be opened so as to achieve the scavenging or purging of the combustion chamber 2. While the aforenoted system is operationally satisfactory, it is believed that a structurally simpler, quicker, and more efficient combustion scavenging or purging process would be more beneficial. More particularly, it is seen that as the power piston 8 of Adams approaches or nears the end of its downward movement or power stroke, and subsequently begins to move upwardly during its return stroke, the scavenging or purging of the combustion chamber 2, by means of the scavenging or purging air disposed within the plenum chamber 4, is, in effect, solely dependent upon the elevated pressure level present within the plenum chamber 4, that is, the pressure level present within the plenum chamber 4 is effectively the sole force causing the scavenging or purging air to flow from the plenum chamber 4 into the combustion chamber 2.

A need therefore exists in the art for a new and improved combustion-powered linear air motor/compressor, for use within combustion-powered tools, wherein the scavenging or purging air will be rammed or forced into, through, and out of the combustion chamber during the return stroke of the power piston assembly so as to rapidly and efficiently scavenge or purge the residual combustion products or exhaust gases from the combustion chamber of the combustion-powered tool.

SUMMARY OF THE INVENTION

The foregoing and other objectives are achieved in accordance with the teachings and principles of the present invention through the provision of a new and improved combustion-powered linear air motor/compressor, for use within combustion-powered tools, such as, for example, combustion-powered fastening driving tools, combustion-powered projectile-firing tools, and the like, wherein the new and improved combustion powered linear air motor/compressor comprises a power piston assembly comprising a power piston disposed within a combustion chamber, and a scavenging piston disposed within a scavenging chamber into which air and fuel are to be respectively ingested and injected so as to form an air/fuel mixture. During the power stroke portion or operative cycle of the combustion-powered tool, the power piston will be moved through the combustion chamber in a power stroke direction and will cause work to be performed, either, for example, by driving a fastener out from the tool, by discharging a projectile out from the tool, or by discharging compressed air out from the tool.

The scavenging piston, which is integrally attached to the power piston, will likewise be moved in the power stroke direction, as a result of which fresh or ambient air will be ingested into the scavenging chamber while a predetermined amount of fuel is also injected into the scavenging chamber so as to effectively form with the ingested fresh or ambient air an air/fuel mixture. Upon completion of the power stroke of the power piston, the directional movement of the power piston, as well as that of the scavenging piston, is reversed whereby during the return strokes of the power and scavenging pistons, the scavenging piston will cause the air fuel mixture, disposed within the scavenging chamber, to effectively be rammed or forced into, through, and out of the combustion chamber so as to quickly and completely scavenge or purge the combustion chamber of its previously generated combustion products or exhaust gases. In this manner, contrary to the operation of, for example, the aforenoted patented system of Adams, the purging or scavenging air, flowing through the combustion chamber, is not, in effect, reliant upon elevated pressure levels developed within a plenum chamber, but is, in effect, a function of the forced return movement of the scavenging piston. Still further, scavenging or purging may also be achieved by means of the power piston during the power stroke portion of the operational cycle.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1:
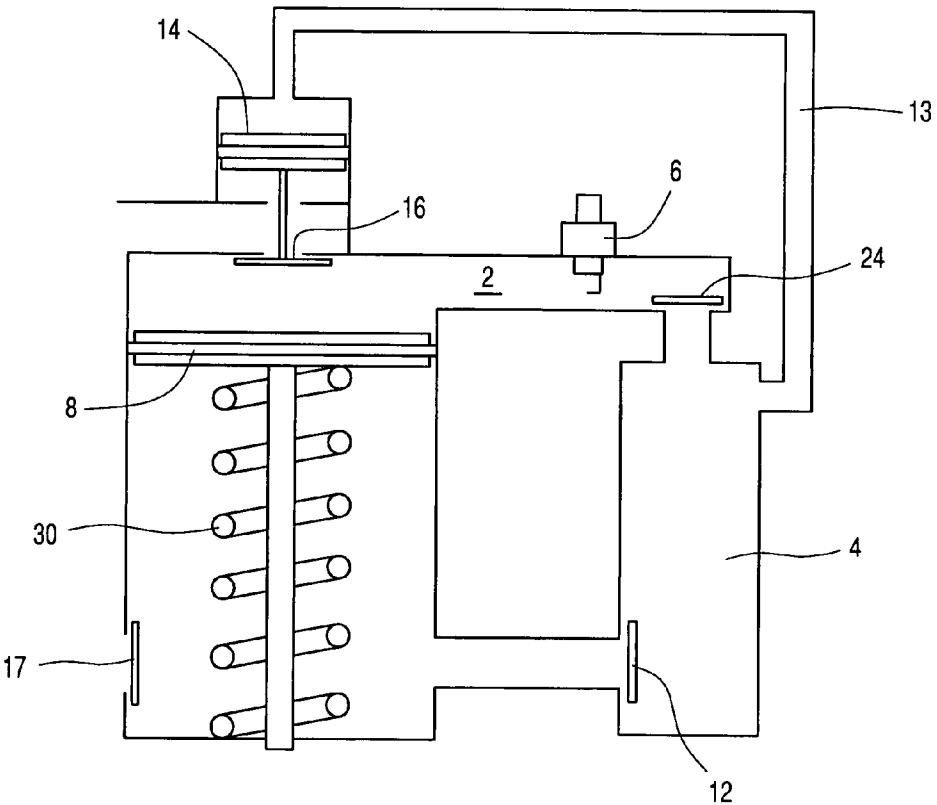
FIG. 1 PRIOR ART
FIG. 1 is a schematic, cross-sectional view of a conventional, PRIOR ART scavenging system for a combustion-powered intermittently operated linear motor.

Referring now to the drawings, and more particularly to FIGS. 2-8 thereof, a first embodiment of a new and improved combustion-powered linear air motor/compressor assembly, as constructed in accordance with the principles and teachings of the present invention, and for use within combustion-powered tools, is disclosed and is generally indicated by the reference character 100. More particularly, the new and improved combustion-powered linear air motor/compressor assembly 100 is seen to comprise a first cylindrical housing 102 within which there is defined a combustion chamber 104. A piston cylinder 106 is also defined internally within the first cylindrical housing 102, and a piston assembly 108 is adapted to be movably disposed within the piston cylinder 106 between its START position, as illustrated within FIG. 2, and its END position, as illustrated within FIG. 7, the movement, for example, of the piston assembly 108, from the START position to the END position, comprising the power stroke of the piston assembly 108. A second cylindrical housing 110 is fixedly connected to the first cylindrical housing 102, and it is seen that the piston assembly 108 comprises a power piston 112 which is adapted to be movably disposed within the piston cylinder 106, and a scavenging piston 114 which is adapted to be movably disposed within the second cylindrical housing 110 between its START position as illustrated within FIG. 2, and its END position as illustrated within FIG. 7. The second cylindrical housing 110 defines an internal space therewithin, and as can be further appreciated from, for example, FIG. 3, the scavenging piston 114 effectively divides or separates the internal space of the second cylindrical housing 110 into a compression chamber 116, within which working air is adapted to be compressed, and a scavenging chamber 118 into which fresh or ambient scavenging air, or an air/fuel mixture, is adapted to be charged or ingested for subsequent conveyance into and through the combustion chamber 104 so as to scavenge or purge combustion products or exhaust gases out from the combustion chamber 104 as will be more fully discussed hereinafter.

Figure 2:
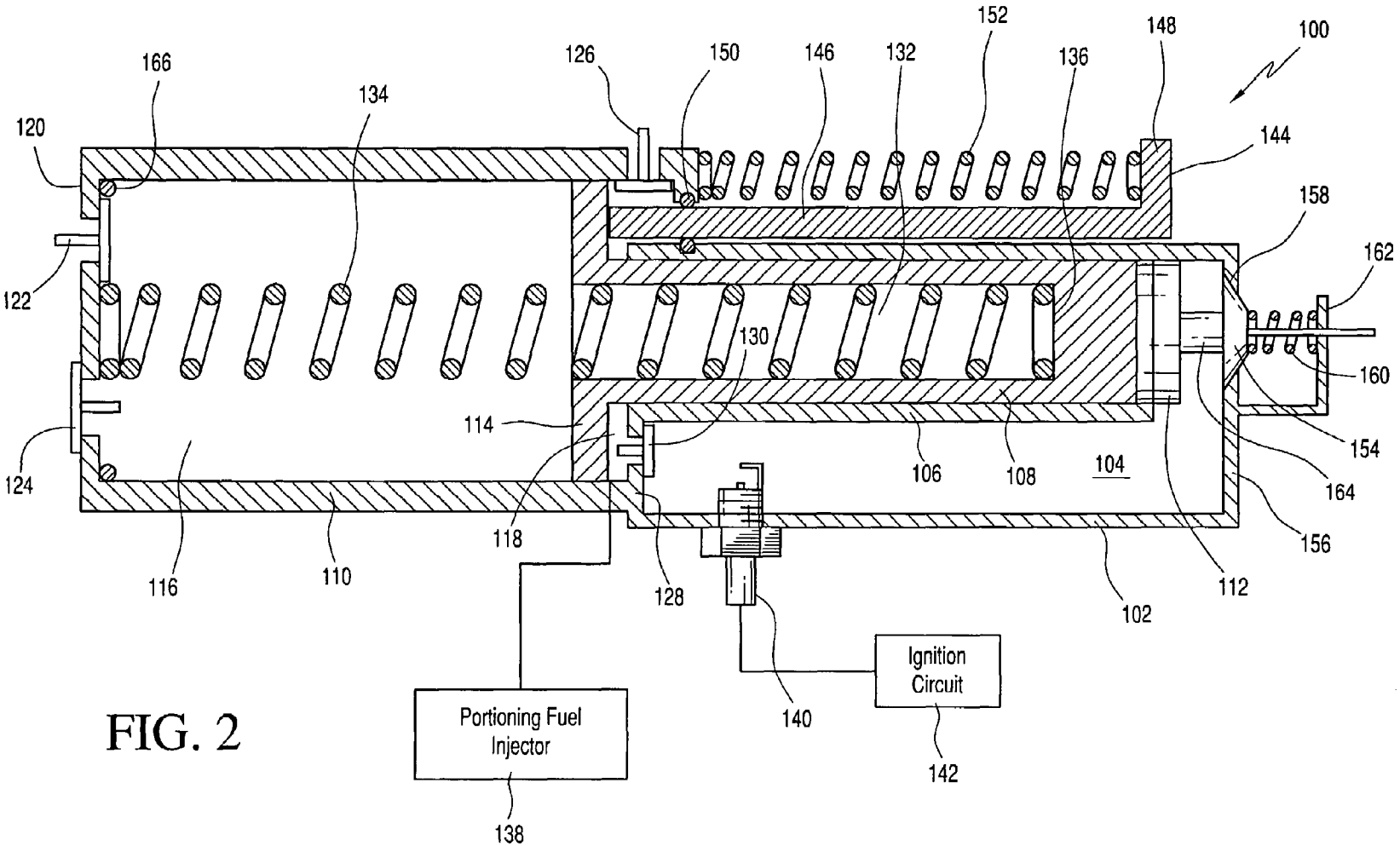
FIG. 2 is a schematic, cross-sectional view of a first embodiment of a new and improved combustion-powered linear air motor/compressor, as constructed in accordance with the principles and teachings of the present invention and for use within combustion-powered tools, wherein the power piston assembly, comprising the power piston and scavenging piston, are disposed at their START positions prior to the commencement of a combustion ignition process or operative cycle.
Figure 3:
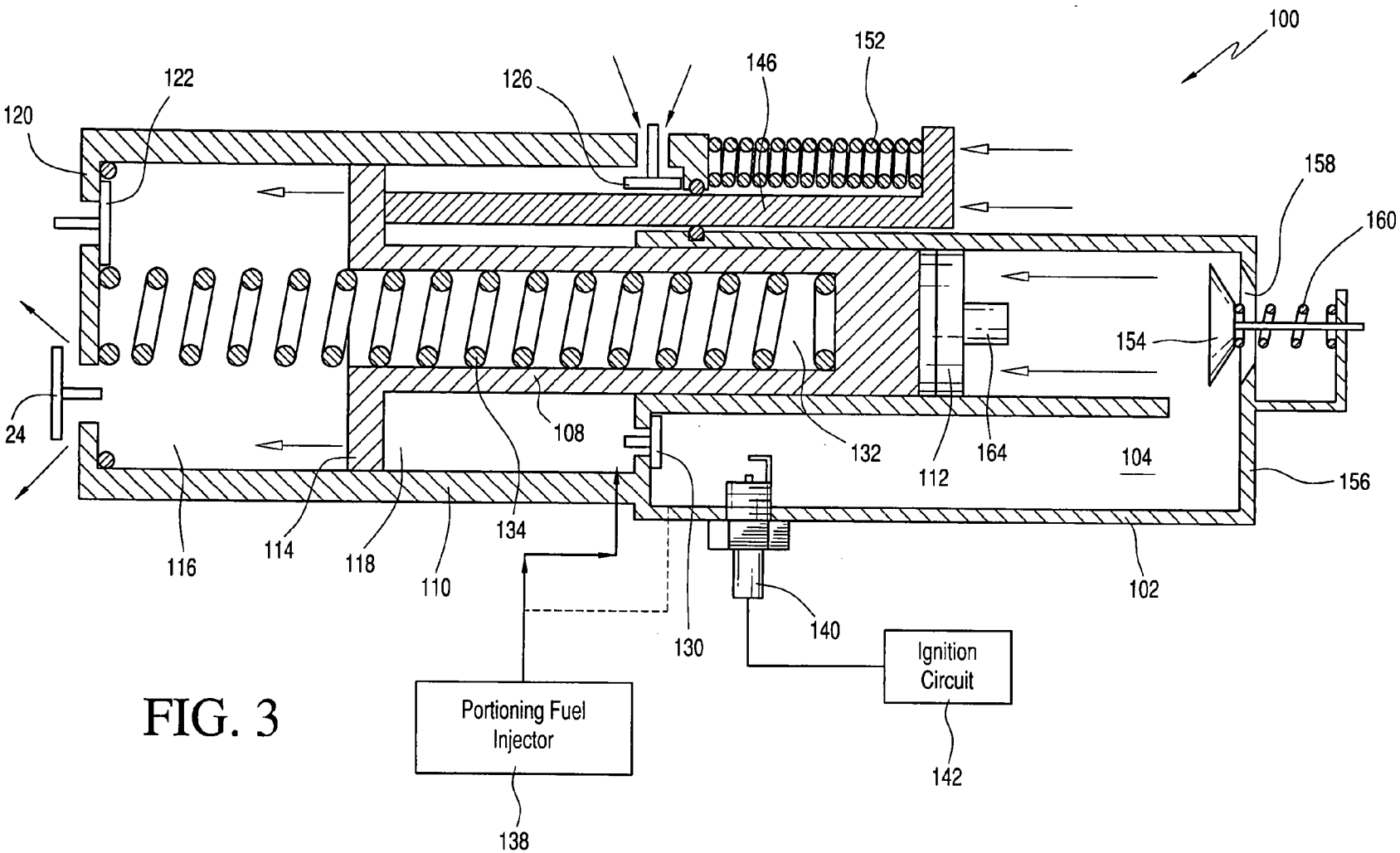
FIG. 3 is a schematic, cross-sectional view of the first embodiment combustion-powered linear air motor/compressor, as disclosed within FIG. 2, wherein, however, a starting plunger, integrally connected to the power piston assembly, has been manually moved from its retracted position, as illustrated within FIG. 1, to an extended position whereby the scavenging chamber has been expanded so as to initiate the combustion process by causing a charge of fresh or ambient air to be ingested into the scavenging chamber along with a predetermined amount of fuel injected into the scavenging chamber, and wherein further, an exhaust valve, disposed within the combustion chamber, has been permitted to be opened.

The second cylindrical housing 110 also comprises an end wall 120 which is remote from the combustion chamber 104, and it is seen that a working air intake valve 122 and a working air outlet valve 124 are mounted within the end wall 120 so as to permit working air to be ingested into, and forcefully discharged from, the compression chamber 116 when the scavenging piston 114 is respectively moved toward the right, and toward the left, as viewed, for example, within FIG. 2, as will also be more fully appreciated hereinafter. In a similar manner, a side wall portion of the second cylindrical housing 110, which is located adjacent to the first cylindrical housing 102, is provided with a scavenging air intake valve 126 so as to permit fresh or ambient scavenging air to be ingested into the scavenging chamber 118 when the scavenging piston 114 is moved in the leftward direction from its START position, as viewed within FIG. 2, to its END position as viewed in FIG. 7, while an end wall member 128, which effectively separates the first cylindrical housing 102 from the second cylindrical housing 110, is provided with a scavenging air outlet valve 130 so as to permit the scavenging air, or the scavenging air/fuel mixture, disposed within the scavenging chamber 118 to be forcefully rammed into the combustion chamber 104 when the scavenging piston 114 is moved in the rightward direction from its END position as viewed in FIG. 7, to its START position as viewed in FIG. 2, as will be discussed more fully hereinafter.

Continuing further, it is also seen that the piston assembly 108 is provided with an axially located and axially extending blind bore 132, and that a first portion of a return spring 134 is disposed within the blind bore 132 such that the right end portion of the return spring 134 is engaged with an end wall portion 136 of the blind bore 132, while a second portion of the return spring 134 is disposed within the compression chamber 116 such that the left end portion of the return spring 134 is engaged with an axially central portion of the end wall 120 of the second cylindrical housing 110. In this manner, the return spring 134 biases the piston assembly 108 toward the right as viewed, for example, within FIGS. 2-8, so as to effectively tend to return the piston assembly 108 toward its original or START position. Still yet further, a portioning fuel injector 138 is mounted within a side wall portion of the second cylindrical housing 110, that is located adjacent to the first cylindrical housing 102 and which is disposed diametrically opposite the scavenging air intake valve 126, so as to inject fuel into the scavenging chamber 118, and a suitable ignition device, such as, for example, a spark plug 140, which is adapted to be controlled or activated by means of a suitable ignition circuit 142, is disposed within the combustion chamber 104 for igniting the air/fuel mixture therewithin. Still yet further, means is provided upon the new and improved combustion-powered linear air motor/compressor assembly 100 in order to effectively prime the assembly 100 so as to permit the same to subsequently intermittently perform its numerous combustion-firing cycles.

More particularly, a manually-actuated starter plunger mechanism 144 is movably mounted upon an external side wall portion of the first cylindrical housing 102, and it is seen that the manually-actuated plunger mechanism 144 comprises an axially extending leg member 146 and a radially extending handle 148. The left or distal end portion of the axially extending leg member 146 is seen to extend through the end wall member 128, which effectively separates the first cylindrical housing 102 from the second cylindrical housing 110, such that the distal end portion of the axially extending leg member 146 will operatively engage the scavenging piston 114. A suitable seal mechanism, such as, for example, an O-ring member 150, is fixedly mounted upon the end wall member 128 and the first cylindrical housing 102 so as to annularly surround the axially extending leg member 146, and it is also seen that a second return spring 152 is interposed between the end wall member 128 and the radially extending handle 148 of the manually-actuated plunger mechanism 144 so as to return the manually-actuated plunger mechanism 144 to its original START position, as illustrated within FIG. 2, after the manually-actuated plunger mechanism 144 has been released subsequent to its having been manually moved to its fully extended position, at which the manually-actuated plunger mechanism 144 will have, for example, caused the scavenging piston 114 of the piston assembly 108 to have attained its END position as illustrated, for example, within FIG. 7. Lastly, it is also noted that the combustion chamber 104 has an exhaust valve 154 which is movably mounted with respect to the end wall member 156 of the combustion chamber 104, which is disposed opposite the end wall member 128 which effectively separates the first cylindrical housing 102 from the second cylindrical housing 110, so as to open and close an exhaust port 158 that is defined within the end wall member 156 of the combustion chamber 104. A spring member 160 is interposed between the head portion of the exhaust valve 154 and a mounting bracket 162 so as to normally bias the exhaust valve 154 to its OPEN position, and it is additionally noted that the power piston 112 has an axially extending lug member or stem 164 fixedly mounted thereon so as to engage the exhaust valve 154 and force the same to attain its CLOSED position, against the biasing force of the spring member 160, when the piston assembly 108 is disposed at its START position as illustrated, for example, within FIG. 2.

Having described substantially all of the structure comprising the first embodiment of the new and improved combustion-powered linear air motor/compressor assembly 100, a brief description of the operation of the new and improved combustion-powered linear air motor/compressor assembly 100 will now be provided. With reference being made, for example, to FIGS. 2 and 3, wherein the disposition of the various structural components of the new and improved combustion-powered linear air motor/compressor assembly 100, at both the START position and at the commencement of an operational combustion firing cycle, can be readily compared, it is initially noted that operator personnel will move the manually-actuated plunger mechanism 144 in the leftward direction, against the biasing force of second return spring 152, from its START position as illustrated within FIG. 2, toward its END position which is not illustrated although an intermediate position of the manually-actuated plunger mechanism 144 is in fact illustrated in FIG. 3. As a result of the aforenoted movement of the manually-actuated plunger mechanism 144, the manually-actuated plunger mechanism 144 will cause the piston assembly 108 to likewise be moved in the leftward direction, against the biasing force of return spring 134, toward its END position, which is illustrated within FIG. 7, as a result of the operative engagement between the distal end portion of the leg member 146 of the plunger mechanism 144 and the scavenging piston 114. It is noted that an annular bumper member 166 is disposed within the second cylindrical housing 110 at a position adjacent to the end wall 120 thereof so as to effectively serve as a shock absorber or the like in order to prevent the scavenging piston 114 from engaging the end wall 120 of the second cylindrical housing 102 with any substantially damaging force.

During such leftward movement of the piston assembly 108, the leftward movement of the scavenging piston 114 will effectively cause the volume of the compression chamber 116 to be reduced while the volume of the scavenging chamber 118 will effectively be increased. Accordingly, working air, disposed within the compression chamber 116, will be exhausted therefrom through means of the working air outlet valve 124 while fresh or ambient scavenging air will be ingested into the scavenging chamber 118 through means of the scavenging air intake valve 126. Still further, as a result of the aforenoted leftward movement of the piston assembly 108, the power piston 112 will likewise be moved from its START position, as illustrated within FIG. 2, toward its END position as illustrated within FIG. 7, and accordingly, the volume of the combustion chamber 104 will effectively be increased. In addition, the lug member or stem 164 of the power piston 112 will be disengaged from the combustion chamber exhaust valve 154 whereby the biasing spring 160, operatively associated with the combustion chamber exhaust valve 154, will move the combustion chamber exhaust valve 154 from its CLOSED position, as illustrated within FIG. 2, to its OPEN position as illustrated within FIG. 3. Accordingly, fresh or ambient air will be ingested into the combustion chamber 104 through means of the combustion chamber exhaust port 158.

Figure 4:
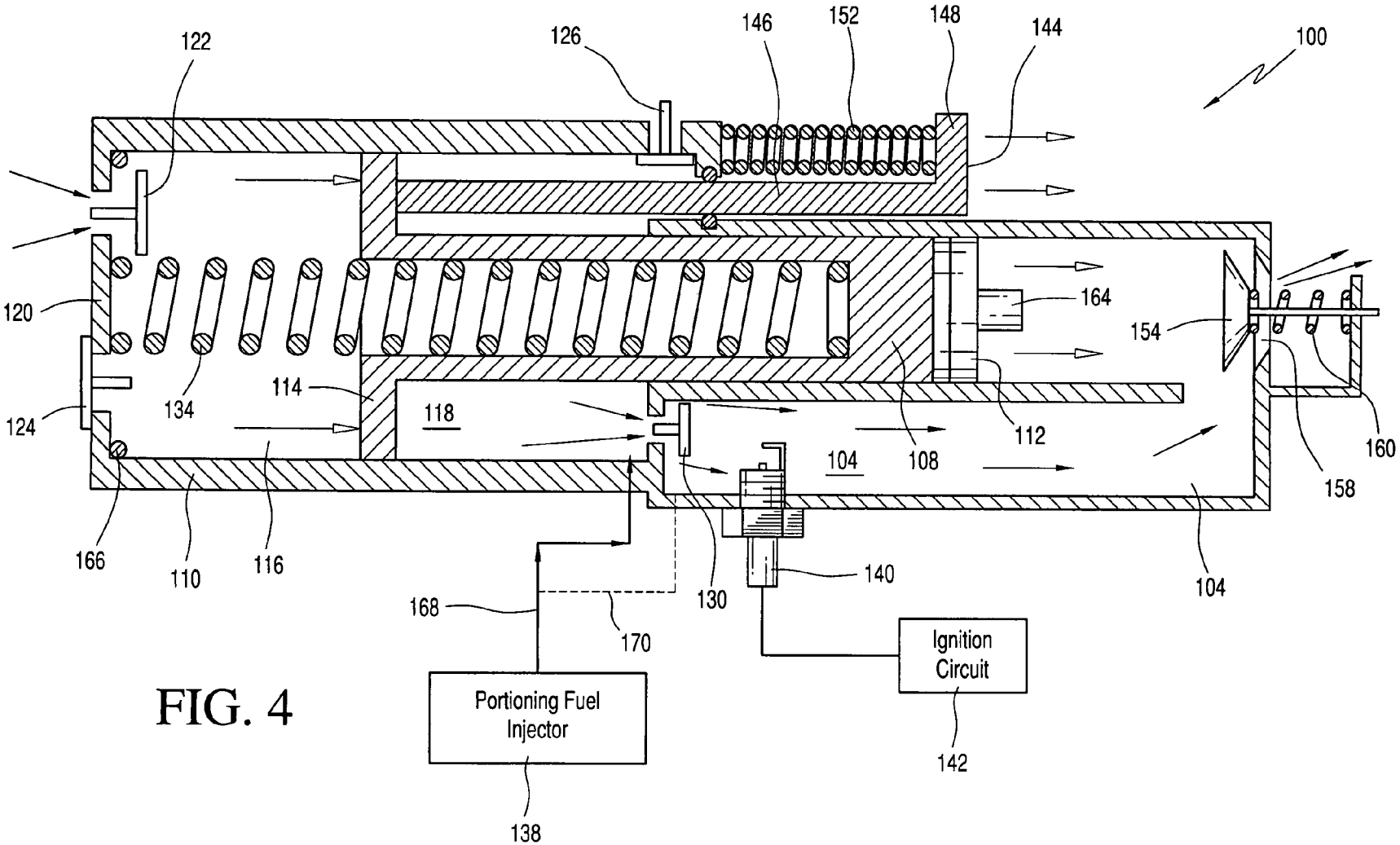
FIG. 4 is a schematic, cross-sectional view of the first embodiment combustion-powered linear air motor/compressor, as disclosed within FIGS. 2 and 3, wherein, however, the starting plunger has now been released whereby the starting plunger and the power piston assembly move back toward their original retracted or START positions, as illustrated within FIG. 2, such that working air is ingested into a compression chamber defined between the scavenging piston the scavenging piston now causes the air/fuel mixture, disposed within the scavenging chamber, to be forced into, through, and out of the combustion chamber, through means of the opened exhaust valve, so as to ensure that any residual combustion products or exhaust gases, present within the combustion chamber, have been scavenged or purged from the combustion chamber.
Figure 5:
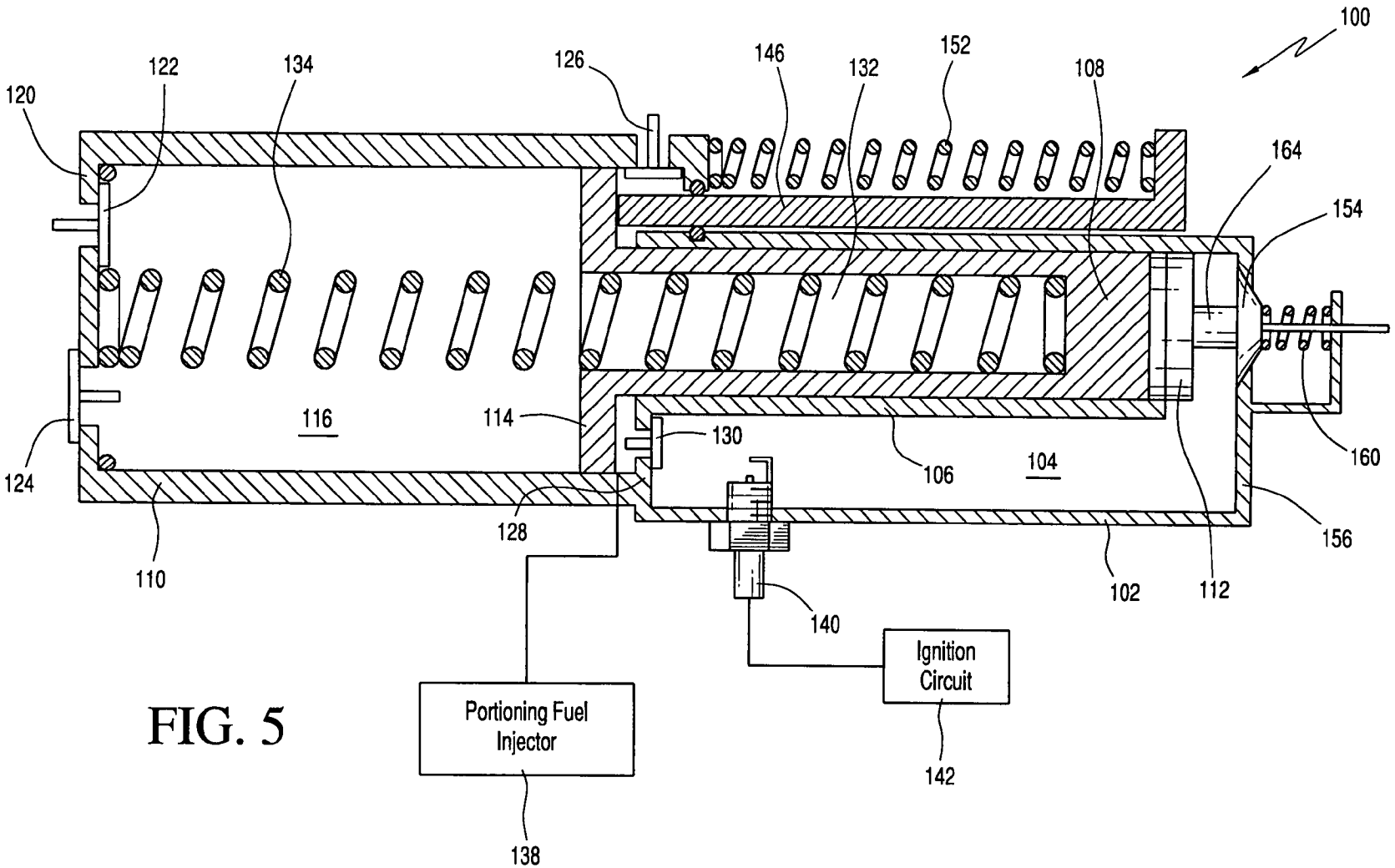
FIG. 5 is a schematic, cross-sectional view of the first embodiment combustion-powered linear air motor/compressor, as disclosed within FIGS. 2-4, wherein, however, the starting plunger and the power piston assembly have now been returned to their original START positions as illustrated within FIG. 2, whereby the exhaust valve of the combustion chamber has been closed and an air/fuel mixture is disposed within the combustion chamber in preparation for the initiation of a combustion cycle.
Figure 7:
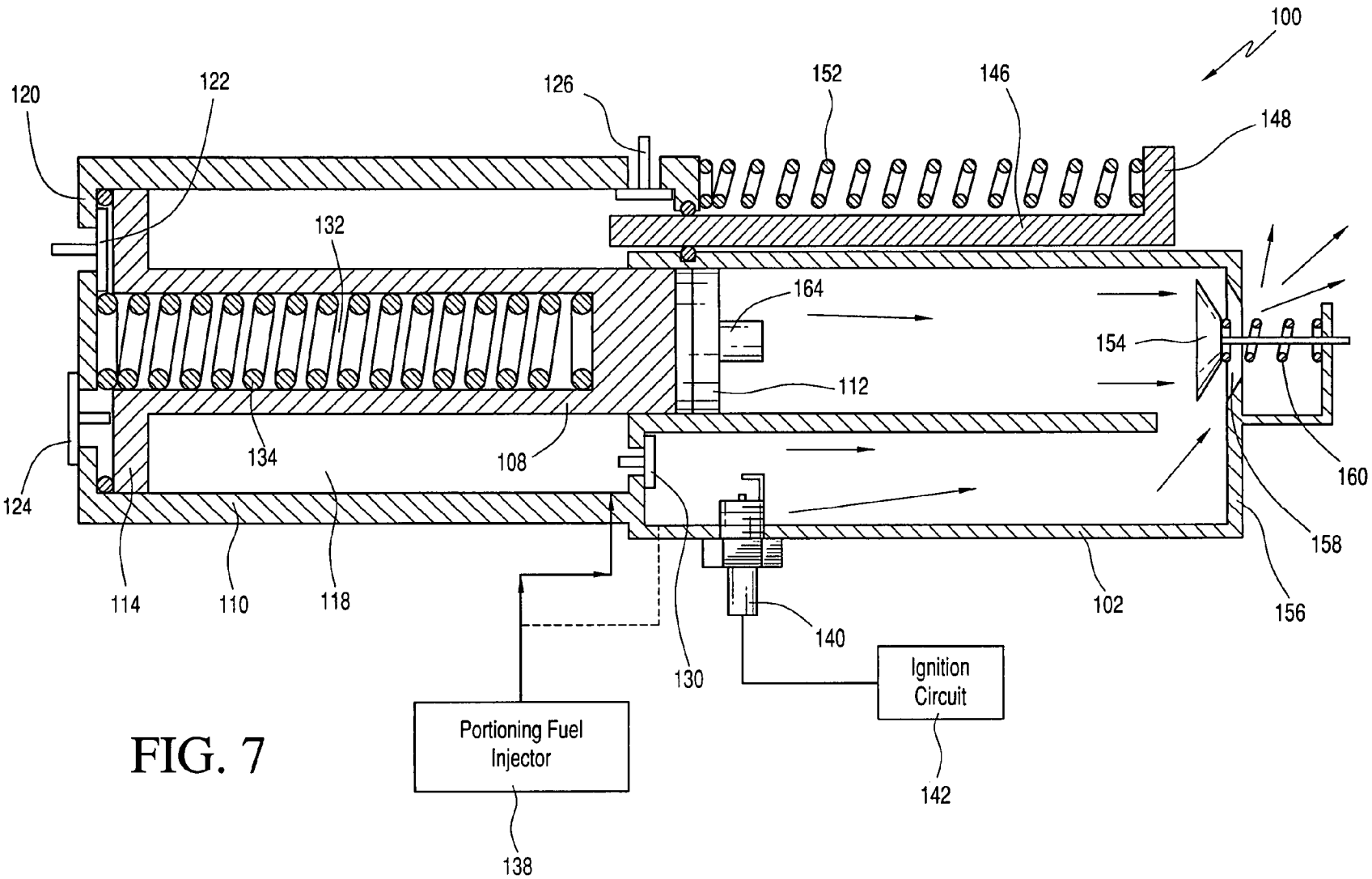
FIG. 7 is a schematic, cross-sectional view of the first embodiment combustion-powered linear air motor/compressor, as disclosed within FIGS. 2-6, wherein, however, the power piston assembly has now reached the end of its power stroke, fresh or ambient air continues to be ingested into the scavenging chamber, predetermined amounts of fuel are injected into the scavenging chamber, and the exhaust valve disposed within the combustion chamber is now opened as a result of a decrease in the pressurized conditions present within the combustion chamber.
Figure 8:
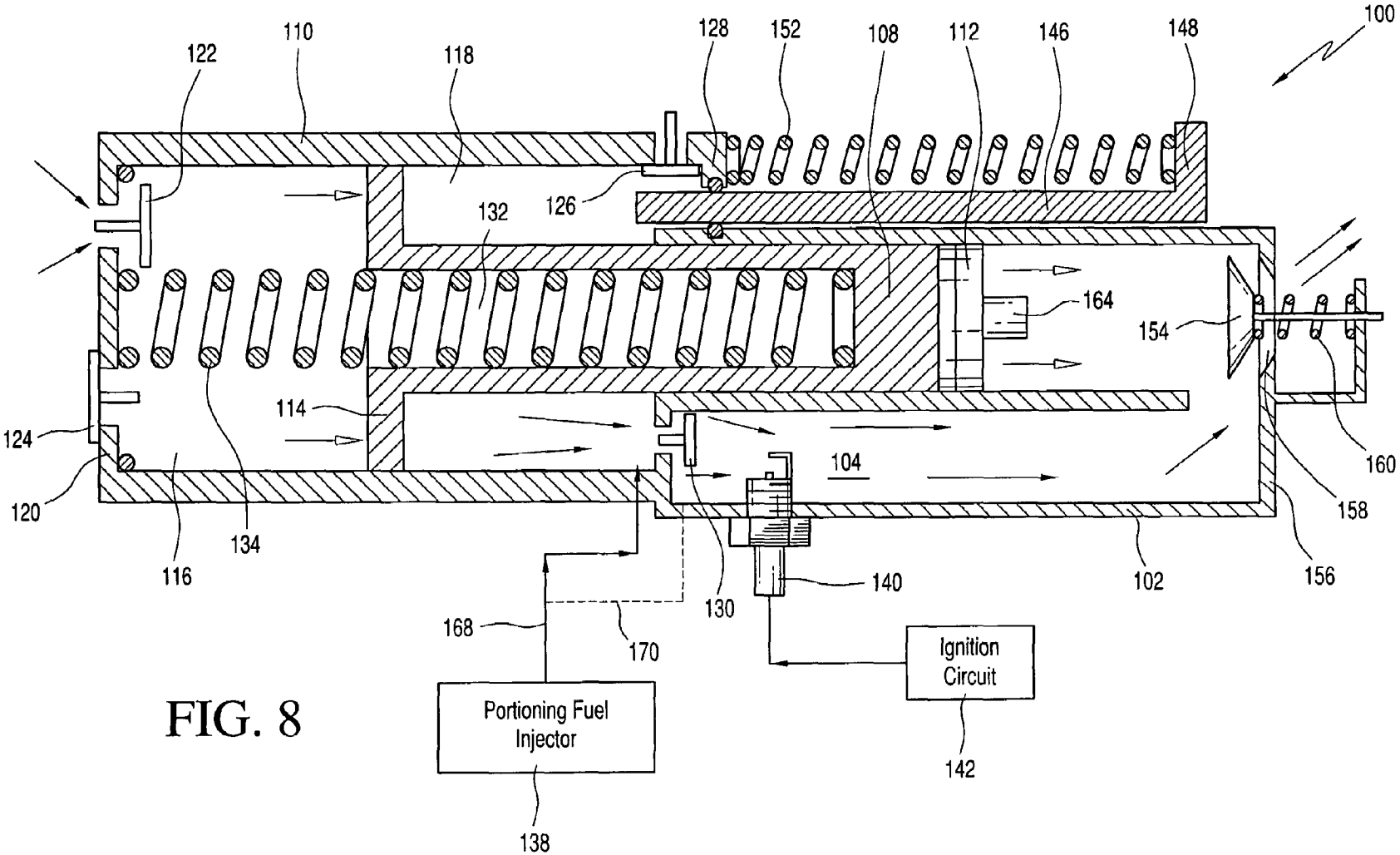
FIG. 8 is a schematic, cross-sectional view of the first embodiment combustion-powered linear air motor/compressor, as disclosed within FIGS. 2-7, wherein, however, the movement of the power piston assembly has now reversed direction and is undergoing its return stroke so as to move back toward its original START position and thereby force combustion products and exhaust gases to be discharged out of the combustion chamber through means of the open exhaust valve disposed within the combustion chamber, a charge of new working air is ingested into the compression chamber, and the scavenging piston forces the air/fuel mixture from the scavenging chamber into, through, and out of the combustion chamber through means of the open exhaust valve disposed within the combustion chamber so as to scavenge or purge the combustion chamber of any residual combustion products or exhaust gases.

Continuing further, once the piston assembly 108 has attained its END position, which is illustrated within FIG. 7, the manually-actuated plunger mechanism 144 is released whereby the first and second return springs 134,152 will respectively move the piston assembly 108 and the manually-actuated plunger mechanism 144 back toward their START positions, which are illustrated within FIG. 2, intermediate return movements of the piston assembly 108 and the manually-actuated plunger mechanism 144 being illustrated within FIG. 4. It can therefore be appreciated that as a result of such return movement of the piston assembly 108, and prior to the piston assembly 108 again being disposed at its START position as illustrated within FIG. 2, the movement of the scavenging piston 114 in the rightward direction, as illustrated within FIG. 4, causes the volume of the compression chamber 116 to be expanded while the volume of the scavenging chamber 118 is decreased. Accordingly, fresh or ambient working air will be ingested into the compression chamber 116 through means of the working air intake valve 122 while fresh or ambient scavenging air will be discharged from the scavenging chamber 118 and into the combustion chamber 104 through means of the scavenging air outlet valve 130.

Predetermined amounts of fuel can be injected into the scavenging chamber 118, by means of the portioning fuel injector 138 and a fluid conduit 168, throughout the return stroke of the scavenging piston 114 from its END position, as illustrated within FIG. 7, to its START position as illustrated within FIG. 2, or alternatively, the fuel can be injected into the scavenging chamber 118 only when the scavenging piston 114 is disposed at a predetermined distance from its START position which will effectively ensure that a full and complete combustible air/fuel mixture is in fact charged into the combustion chamber 104. Alternatively still further, fuel can also be injected directly into the combustion chamber 104 by means of an auxiliary fluid line or conduit 170. In either case, scavenging air, or an air fuel mixture, will flow through the combustion chamber 104 and be exhausted outwardly from the combustion chamber 104 through means of the combustion chamber exhaust port 158. Ultimately, when the scavenging piston 114 and the power piston 112 have been returned to their START positions as illustrated within FIG. 5, the lug member or stem 164 of the power piston 112 will again engage the combustion chamber exhaust valve 154 so as to seat the valve 154 upon its valve seat against the biasing force of the spring member 160, and a suitable air/fuel mixture will be disposed within the combustion chamber 104. It is to be noted that the biasing force of return spring 134 is substantially greater than the biasing force of the exhaust valve spring 160 whereby in fact the rightward movement of the power piston 112, under the biasing force or influence of the return spring 134, can in fact force the combustion chamber exhaust valve 154 to its CLOSED position against the biasing force of the exhaust valve spring 160. At this point in time, as illustrated within FIG. 5, the tool, within which the new and improved combustion powered linear air motor/compressor assembly 100 of the present invention is disposed, is ready to be fired and combustion can in fact be commenced.

Figure 6:
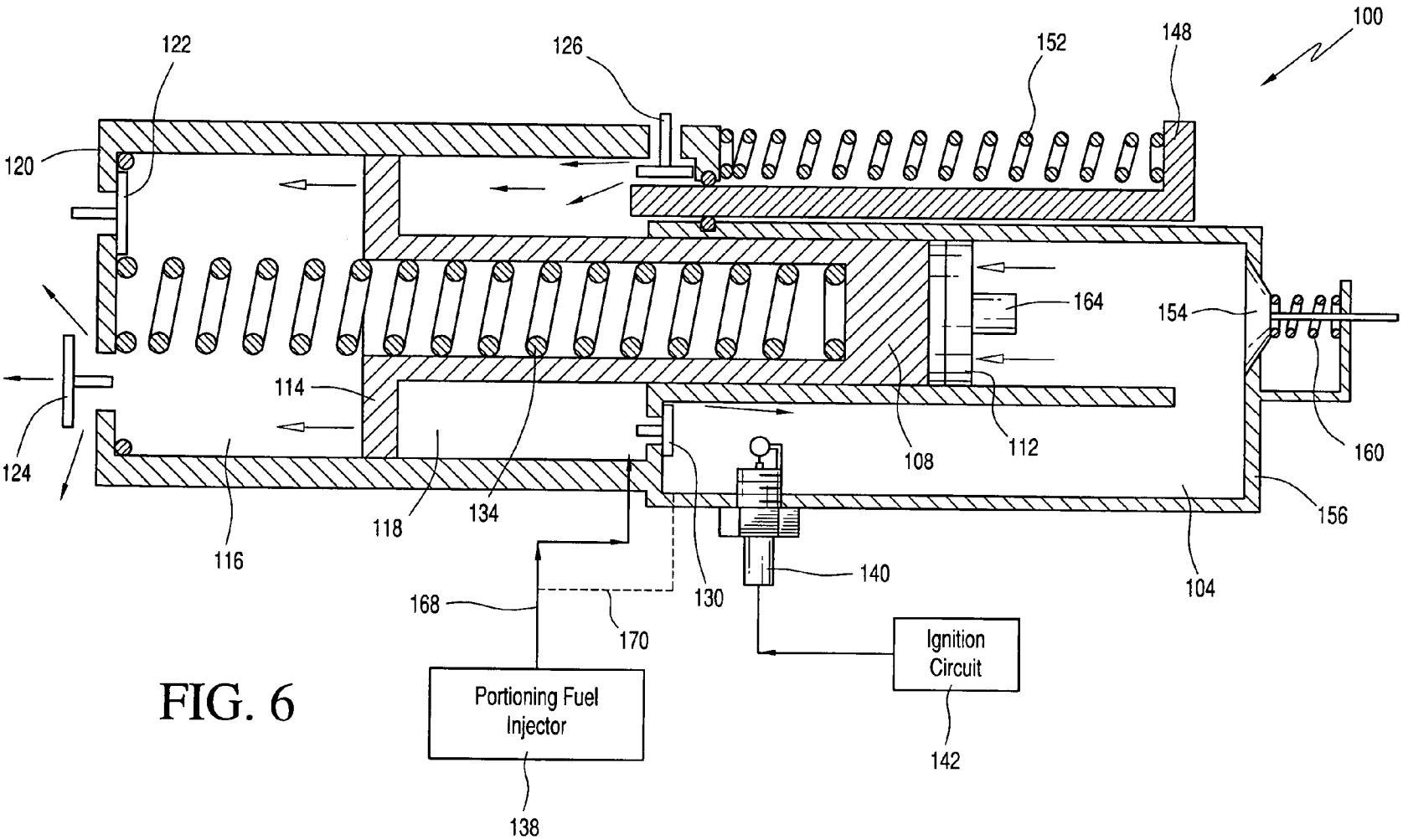
FIG. 6 is a schematic, cross-sectional view of the first embodiment combustion-powered linear air motor/compressor, as disclosed within FIGS. 2-5, wherein, however, combustion has now been initiated within the combustion chamber whereby the power piston assembly has now started to move through its power stroke so as to, for example, force working air out from the compression chamber, fresh or ambient air is ingested into the scavenging chamber, and the exhaust valve disposed within the combustion chamber is maintained closed as a result of the pressurized conditions present within the combustion chamber.

Accordingly, with reference now being made to FIG. 6, when the air/fuel mixture disposed within the combustion chamber 104 is ignited by means of the spark plug 140, the elevated pressure levels prevailing within the combustion chamber 104 will cause the piston assembly 108 to be moved toward the left, as viewed in FIG. 6, whereby the movement of the scavenging piston 114 will reduce the volume of the compression chamber 116 and working air will be forcefully discharged from the compression chamber 116 through means of the working air outlet valve 124. Correspondingly, the leftward movement of the scavenging piston 114 will cause the volume of the scavenging chamber 118 to be increased whereby fresh or ambient air will be ingested into the scavenging chamber 118 through means of the scavenging air intake valve 126. In short, the operation of the combustion-powered linear air motor/compressor assembly 100, under such combustion conditions, is substantially the same as that described in connection with the manual movement of the manually-actuated plunger mechanism 144, as has been previously described in connection with FIG. 3, with the important exception being that as a result of the elevated pressure levels present in the combustion chamber 104 due to the ignition of the air fuel mixture therewithin, the combustion chamber exhaust valve 154 is maintained at its CLOSED position despite the fact that the lug member or stem 164 of the power piston 112 has been disengaged from the combustion chamber exhaust valve 154.

Continuing further, and with reference now being made to FIG. 7, the leftward movement of the piston assembly 108 continues until the piston assembly 108 reaches its END position as illustrated within FIG. 7. At this point in time, substantially all of the working air previously disposed within the compression chamber 116 has been discharged from the compression chamber 116 through means of the working air outlet valve 124, and a charge of fresh or ambient air has been ingested into the scavenging chamber 118 so as to substantially completely fill the same. The directional movement of the piston assembly 108 is therefore ready to be reversed, and it is also noted that at this point in time, due to the leftward movement of the piston assembly 108, and the corresponding leftward movement of the power piston 112 within the combustion chamber 104, the volume of the combustion chamber 104 has been substantially increased whereby the pressure levels prevailing within the combustion chamber 104 have been substantially reduced. Accordingly, the exhaust valve spring 160 is able to unseat the combustion chamber exhaust valve 154 from its valve seat and thereby open the combustion chamber exhaust port 158 such that residual combustion products or exhaust gases can begin to be vented or exhausted out from the combustion chamber 104. In addition, as a result of the aforenoted drop or reduction in the pressure levels within the combustion chamber 104, the first return spring 134 is able to cause the piston assembly 108 to reverse its directional movement whereby the piston assembly 108 will now begin to move back toward its original or START position, as illustrated within FIG. 8, from the END position as illustrated within FIG. 7. As was the case when the various structural components of the combustion-powered linear air motor/compressor assembly 100 were disposed at their intermediate return positions, as illustrated within FIG. 4, subsequent to the release of the manually-actuated plunger mechanism 144, the movement of the scavenging piston 114 in the rightward direction, as illustrated within FIG. 8, will cause the volume of the compression chamber 116 to be increased while the volume of the scavenging chamber 118 is correspondingly decreased.

Accordingly, a new charge of fresh or ambient working air will be ingested into the compression chamber 116 through means of the working air intake valve 122 while the new charge of fresh or ambient scavenging air, that was previously ingested into the scavenging chamber 118 during the power stroke of the piston assembly 108, will be discharged from the scavenging chamber 118 and into the combustion chamber 104 through means of the scavenging air outlet valve 130. As was previously noted in connection with the description of FIG. 4, predetermined amounts of fuel can be injected into the scavenging chamber 118, by means of the portioning fuel injector 138 and the fuel line or conduit 168, throughout the return stroke of the scavenging piston 114 from its END position, as illustrated within FIG. 7, to its START position as illustrated within FIG. 5, or alternatively, the fuel can be injected into the scavenging chamber 118, as well as directly into the combustion chamber 104 by means of the auxiliary fuel line or conduit, only when the scavenging piston 114 is disposed at a predetermined distance from its START position which will effectively ensure that a full and complete combustible air/fuel mixture is in fact charged into the combustion chamber 104.

In either case, scavenging air, or the scavenging air/fuel mixture, will be forcefully conducted or rammed through the combustion chamber 104 so as to thoroughly scavenge or purge the residual combustion products or exhaust gases outwardly therefrom as a result of being exhausted through means of the combustion chamber exhaust port 158. Ultimately, when the scavenging piston 114 and the power piston 112 have been returned to their START positions as illustrated within FIG. 5, the lug member or stem 164 of the power piston 112 will again engage the combustion chamber exhaust valve 154 so as to seat the valve 154 upon its valve seat against the biasing force of the spring member 160, and a suitable air/fuel mixture will be disposed within the combustion chamber 104. At this point in time, as illustrated within FIG. 5, the tool, within which the new and improved combustion powered linear air motor/compressor assembly 100 of the present invention is disposed, is ready for another combustion firing cycle.

Figure 9:
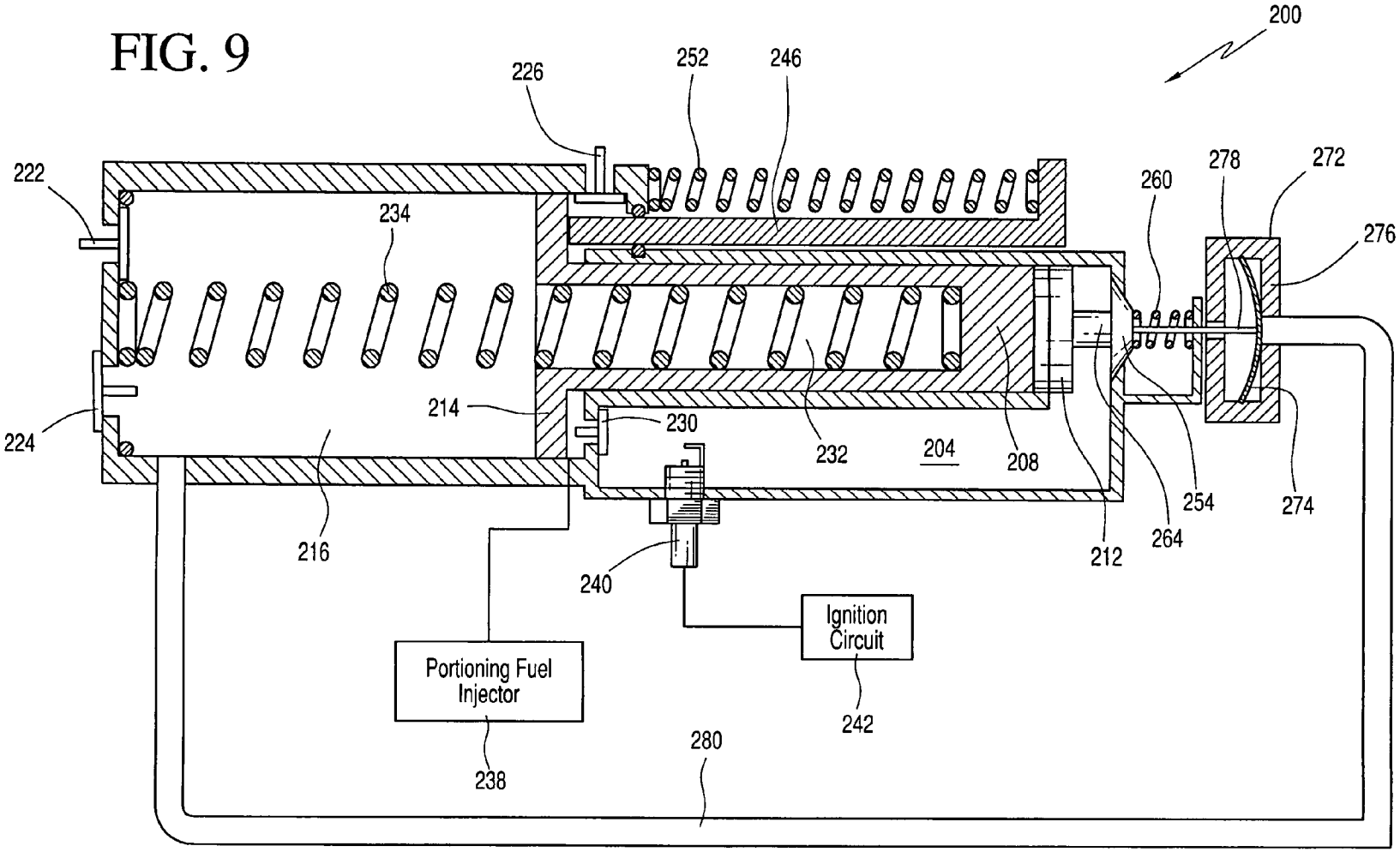
FIG. 9 is a schematic, cross-sectional view, similar to that of FIG. 2, showing, however, a second embodiment of a new and improved combustion-powered linear air motor/compressor wherein a diaphragm, operatively associated with the exhaust valve disposed within the combustion chamber, is fluidically connected to the compression chamber by means of a fluidic signal line whereby depending upon the pressure levels present within the compression chamber, the diaphragm assembly can assist the biasing spring, operatively associated with the exhaust valve disposed within the combustion chamber, to move the exhaust valve to its OPEN position.

With reference now being made to FIG. 9, a second embodiment of a new and improved combustion-powered linear air motor/compressor, as constructed in accordance with the principles and teachings of the present invention, and showing the cooperative parts thereof, is disclosed and is generally indicated by the reference character 200. It is initially noted that in view of the basic structural similarities between the second embodiment combustion-powered linear air motor/compressor 200, as disclosed within FIG. 9, and the first embodiment combustion-powered linear air motor/compressor 100, as disclosed within FIGS. 2-8, a detailed description of the second embodiment combustion-powered linear air motor/compressor 200 will be omitted herefrom for brevity purposes, the description of the same being confined to the differences between the first and second embodiment combustion-powered linear air motor/compressors 100,200. In addition, it is also noted that component parts of the second embodiment combustion-powered linear air motor/compressor 200 which correspond to component parts of the first embodiment combustion-powered linear air motor/compressor 100 will be designated by corresponding reference characters except that they will be within the 200 series. More particularly, it is noted that the only significant structural difference between the second embodiment combustion-powered linear air motor-compressor 200 and the first embodiment combustion-powered linear air motor compressor 100 resides in the fact that a diaphragm assembly 272 is operatively associated with the combustion chamber exhaust valve 254. Specifically, it is seen that the diaphragm assembly 272 comprises a diaphragm member 274 which is disposed internally within a diaphragm chamber 276 wherein the diaphragm member 274 is either disposed immediately adjacent to or is in fact fixedly connected to a valve stem portion 278 of the combustion chamber exhaust valve 254. In addition, it is also seen that the diaphragm assembly 272 is fluidically connected to the compression chamber 216 by means of a fluidic signal line 280 whereby depending upon the pressure levels present within the compression chamber 216, the diaphragm assembly 272 can effectively assist the biasing spring 260, operatively associated with the combustion chamber exhaust valve 254 to be moved to its OPEN position during the latter stage of the combustion-powered power stroke of the piston assembly 208.

Figure 10:
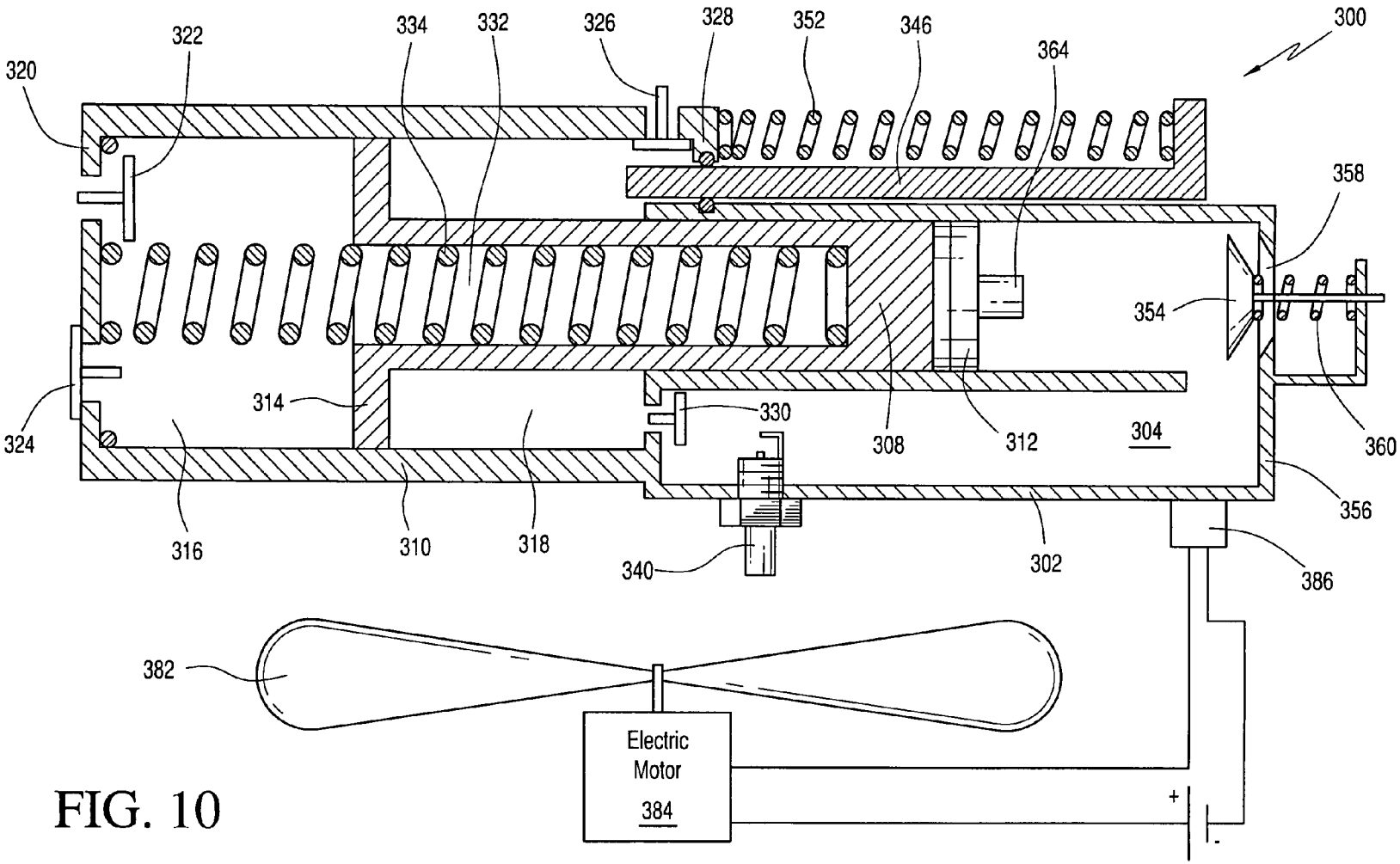
FIG. 10 is a schematic, cross-sectional view, similar to that of FIG. 2, showing, however, a third embodiment of a new and improved combustion-powered linear air motor/compressor wherein an electrically driven cooling fan, activated by means of a thermally activated switch mechanism, is operatively associated with the motor in order to cool the same when required.

With reference now being made to FIG. 10, a third embodiment of a new and improved combustion-powered linear air motor/compressor, as constructed in accordance with the principles and teachings of the present invention, and showing the cooperative parts thereof, is disclosed and is generally indicated by the reference character 300. It is initially noted that in view of the basic structural similarities between the third embodiment combustion-powered linear air motor/compressor 300, as disclosed within FIG. 10, and the first embodiment combustion-powered linear air motor/compressor 100, as disclosed within FIGS. 2-8, a detailed description of the third embodiment combustion-powered linear air motor/compressor 300 will be omitted herefrom for brevity purposes, the description of the same being confined to the differences between the first and third embodiment combustion-powered linear air motor/compressors 100,300. In addition, it is also noted that component parts of the third embodiment combustion-powered linear air motor/compressor 300 which correspond to component parts of the first embodiment combustion-powered linear air motor/compressor 100 will be designated by corresponding reference characters except that they will be within the 300 series. More particularly, it is noted that the only significant structural difference between the third embodiment combustion-powered linear air motor-compressor 300 and the first embodiment combustion-powered linear air motor compressor 100 resides in the fact that a cooling fan 382 is adapted to be mounted upon an external portion of the combustion powered linear air motor/compressor 300 so as to be operatively associated with the first and second cylindrical housings 302,310 thereof, which will tend to experience an increase in temperature levels due to the heat generated within the combustion chamber 304. The cooling fan 382 is driven by means of an electrical motor 384 which is automatically intermittently activated by means of a thermal or heat-activated switch mechanism 386 which is mounted, for example, upon an external wall portion of the first cylindrical housing 302 so as to directly sense or determine a predetermined temperature level of the first cylindrical housing 302 as a result of the heat generated within the combustion chamber 304. It is also noted that the external surface portions of, for example, the first and second cylindrical housings 302,310, may comprise cooling fin structure so as to facilitate the cooling process still further.

Figure 11:
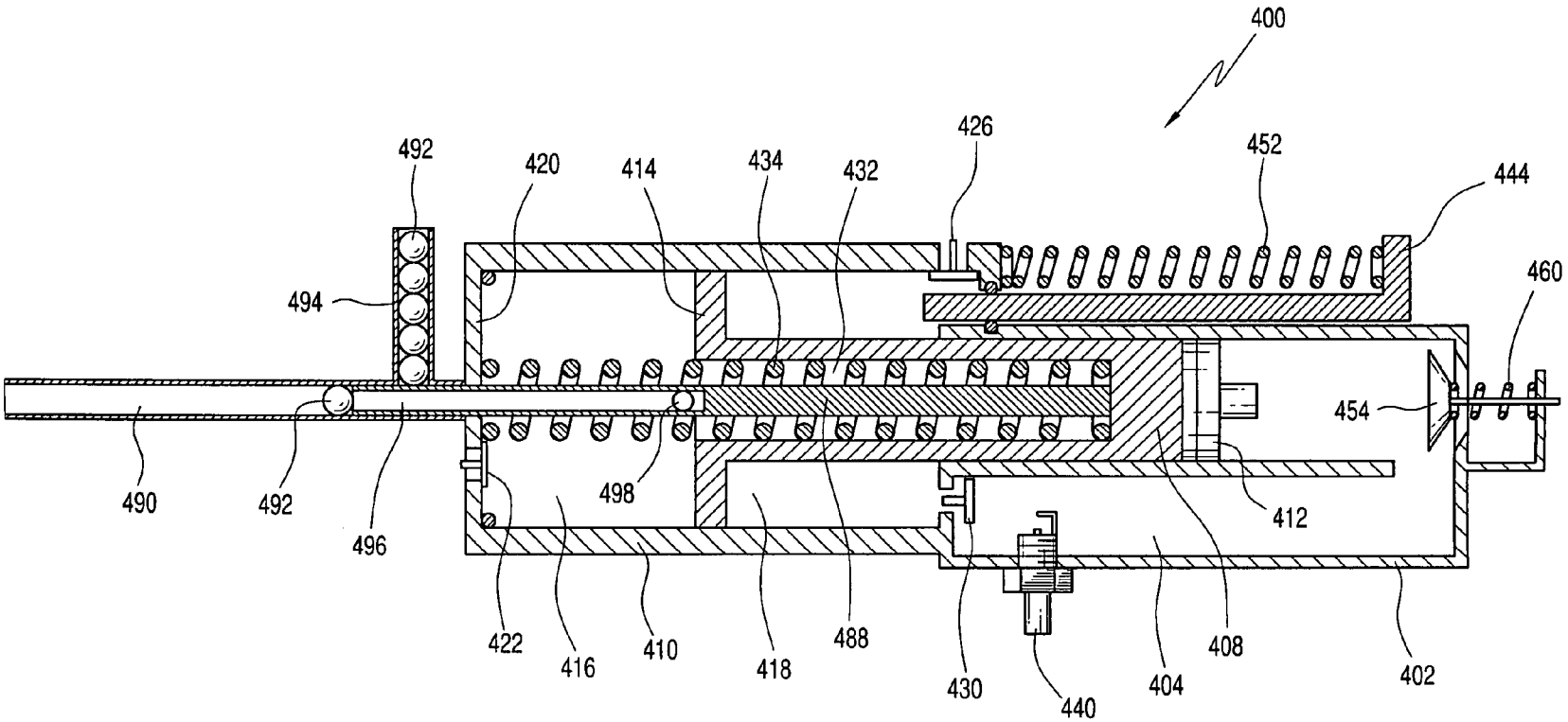
FIG. 11 is a schematic, cross-sectional view, similar to that of FIG. 2, showing, however, a fourth embodiment of a new and improved combustion-powered linear air motor/compressor wherein the power piston assembly has operatively associated therewith a shaft or rod which is utilized for launching projectiles, such as, for example, paint balls, out from a paintball marker tool.

With reference now being made to FIG. 11, a fourth embodiment of a new and improved combustion-powered linear air motor/compressor, as constructed in accordance with the principles and teachings of the present invention, and showing the cooperative parts thereof, is disclosed and is generally indicated by the reference character 400. It is initially noted that in view of the basic structural similarities between the fourth embodiment combustion-powered linear air motor/compressor 400, as disclosed within FIG. 11, and the first embodiment combustion-powered linear air motor/compressor 100, as disclosed within FIGS. 2-8, a detailed description of the fourth embodiment combustion-powered linear air motor/compressor 400 will be omitted herefrom for brevity purposes, the description of the same being confined to the differences between the first and fourth embodiment combustion-powered linear air motor/compressors 100,400.

In addition, it is also noted that component parts of the fourth embodiment combustion-powered linear air motor-compressor 400 which correspond to component parts of the first embodiment combustion-powered linear air motor-compressor 100 will be designated by corresponding reference characters except that they will be within the 400 series. More particularly, it is noted that the primary structural difference between the fourth embodiment combustion-powered linear air motor/compressor 400 and the first embodiment combustion-powered linear air motor compressor 100 resides in the fact that in lieu of the combustion-powered linear air motor compressor outputting working air as the expended work, the combustion-powered linear air motor compressor 400 is effectively adapted to be incorporated within a projectile launching tool, more specifically a paintball marker which launches paintballs.

More particularly, as can readily be appreciated from FIG. 11 wherein the fourth embodiment combustion-powered linear air motor/compressor 400 is disclosed, when compared to the first embodiment combustion-powered linear air motor/compressor 100 as disclosed, for example, within FIG. 2, it is seen that the working air outlet valve 124 of the first embodiment combustion-powered linear air motor/compressor 100 has been eliminated, and that a piston rod assembly 488 has been fixedly mounted within the piston assembly 408 such that an upstream or right end portion of the piston rod assembly 488 is disposed within the blind bore 432 of the piston assembly 408 while the central portion of the piston rod assembly 488 passes through the scavenging piston 414. In addition, the downstream or left end portion of the piston rod assembly 488 passes through an axially central portion of the end wall member 420 of the second cylindrical housing 410 and extends into a projectile launching tube 490 of the paint ball marker so as to launch a projectile, such as, for example, a paintball 492, during the power stroke of the piston assembly 408. A plurality of paintballs 492 are adapted to be disposed within a supply magazine or hopper 494, and it can readily be appreciated that when the piston assembly 408 is moved back or returned to its original or START position, similar to the original or START position as illustrated in connection with the piston assembly 108 as disclosed within FIG. 2, the forward or left end portion of the piston rod assembly 488 will effectively uncover the discharge port of the magazine or hopper 494 so as to permit the leading one of the paintballs 492 to enter the projectile launching tube 490 in preparation for being launched when the piston assembly 408 is then moved through its power stroke as a result of the ignition of the air/fuel mixture within the combustion chamber 404. It is also noted that the downstream or left end portion of the piston rod assembly 488 comprises a hollow tubular section 496 and that a through-bore or aperture 498 is defined within the right end portion of the tubular section 496. In this manner, when the piston assembly 408 is moved toward the left, air disposed within the compression chamber 416 is able to be exhausted through bore or aperture 498 and tubular section 496 so as to propel the paintball 492 out from the paintball marker launching tube 490.

Figure 12:
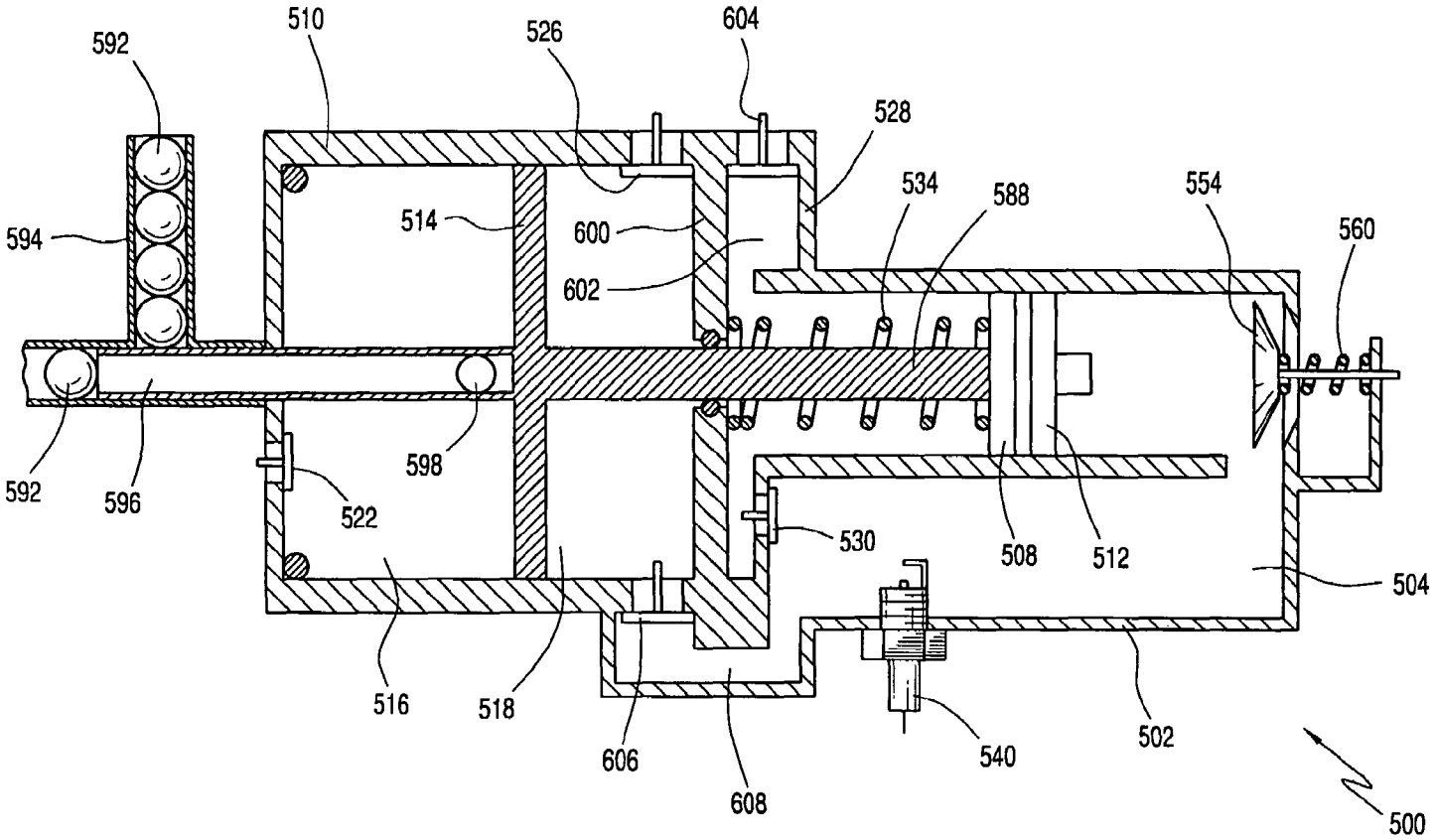
FIG. 12 is a schematic, cross-sectional view, similar to that of FIG. 11, showing, however, a fifth modified embodiment of the paintball marker tool wherein, in addition to the scavenging piston performing a combustion product or exhaust gas scavenging or purging operation during a return stroke portion of the overall combustion cycle, the power piston also performs a combustion product or exhaust gas scavenging or purging operation during the power stroke portion of the overall combustion cycle.

Referring now to FIG. 12, there is disclosed a fifth embodiment of a new and improved combustion-powered linear air motor/compressor, as constructed in accordance with the principles and teachings of the present invention, which is effectively a modified embodiment of the paintball marker tool as disclosed within FIG. 11, and which is designated by means of the reference character 500. Accordingly, it is noted that in view of the basic structural similarities between the fifth embodiment combustion-powered linear air motor/compressor/paintball marker 500, as disclosed within FIG. 12, and the fourth embodiment combustion-powered linear air motor/compressor/paintball marker 400 as disclosed within FIG. 11, a detailed description of the fifth embodiment combustion-powered linear air motor/compressor/paintball marker 500 will be omitted herefrom for brevity purposes, the description of the same being confined to the differences between the fourth and fifth embodiment combustion-powered linear air motor/compressor/paintball markers 400,500. In addition, it is also noted that component parts of the fifth embodiment combustion-powered linear air motor/compressor paintball marker 500 which correspond to component parts of the fourth embodiment combustion-powered linear air motor-compressor/paintball marker 400 will be designated by corresponding reference characters except that they will be within the 500 and 600 series. As can be appreciated from FIG. 12, it is seen that in accordance with the structural features comprising the fifth embodiment combustion-powered linear air motor-compressor paintball marker 500, as compared to the structural features comprising the fourth embodiment combustion-powered linear air motor compressor paintball marker 400 as disclosed within FIG. 11, several structural differences have been implemented into the fifth embodiment combustion-powered linear air motor-compressor paintball marker 500 such that enhanced scavenging or purging of the residual combustion products or exhaust gases, outwardly from the combustion chamber 504, can be achieved.

More particularly, it is seen, for example, that the right end portion of the piston rod assembly 588 is integrally connected to the power piston 512, and in addition, the piston rod assembly 588 is seen to pass through a divider wall or partition 600 which is disposed within the second cylindrical housing 510 so as to be spaced from the end wall 528 and which now effectively separates the combustion chamber 504 from the scavenging chamber 518. The return spring 534 is also now interposed between the divider wall 600 and the power piston 512. In addition, the end wall member 528, which effectively separates the first cylindrical housing 502 from the second cylindrical housing 510, effectively cooperates with the divider wall or partition 600 so as to define an antechamber 602, into which fresh or ambient scavenging air is inducted or ingested through means of a second scavenging air intake valve 604, and from which the fresh or ambient scavenging air is adapted to be discharged into the combustion chamber 504 through means of the scavenging air outlet valve 530. Still further, a second scavenging air outlet valve 606 is provided within a wall portion of the second cylindrical housing 510, and a conduit 608 fluidically interconnects the scavenging chamber 518 to the combustion chamber 504. It is lastly noted that while a manually-actuated starting plunger mechanism, similar to the starting plunger mechanism 144, is not illustrated within this embodiment for clarity purposes, it is nevertheless provided upon an external circumferential wall portion of the first cylindrical housing 502.

In light of the foregoing structure, it is therefore to be appreciated that during, for example, a power stroke of the piston assembly 508, wherein the piston assembly 508 is moving toward the left as viewed within FIG. 12, working air will be forced out from the compression chamber 516 through means of the aperture or through-bore 598 and the hollow tubular portion 596 of the piston rod assembly 588, and substantially simultaneously therewith, fresh or ambient scavenging air is ingested or inducted into the scavenging chamber 518 through means of the scavenging air intake valve 526. In a similar manner, during, for example, a return stroke of the piston assembly 508, wherein the piston assembly 508 is moving toward the right as viewed within FIG. 12, the fresh or ambient scavenging air disposed within the scavenging chamber 518 will now be forcefully rammed into the combustion chamber 504 through means of the second scavenging air outlet valve 606 and the conduit 608 fluidically connecting the scavenging chamber 518 to the combustion chamber 504. In addition, it is noted further that during the return stroke of the piston assembly 508, fresh or ambient scavenging air is also ingested or inducted into the antechamber 602 through means of the second scavenging air intake valve 604 whereupon, during the next power stroke of the piston assembly 508, the fresh or ambient scavenging air disposed within the antechamber 602 will be forcefully rammed into the combustion chamber 504 through means of the scavenging air outlet valve 530. It can therefore be appreciated that as a result of the particular structure characteristic of the fifth embodiment combustion-powered linear air motor-compressor paintball marker 500, scavenging or purging of the residual combustion gases or exhaust products within the combustion chamber 504 occurs during both the power and return strokes of the piston assembly 508. This dual scavenging cycle is therefore beneficial in enhancing the overall scavenging or purging efficiency of the tool or implement 500 with respect to the residual combustion gases or exhaust products within the combustion chamber 504.

Figure 13:
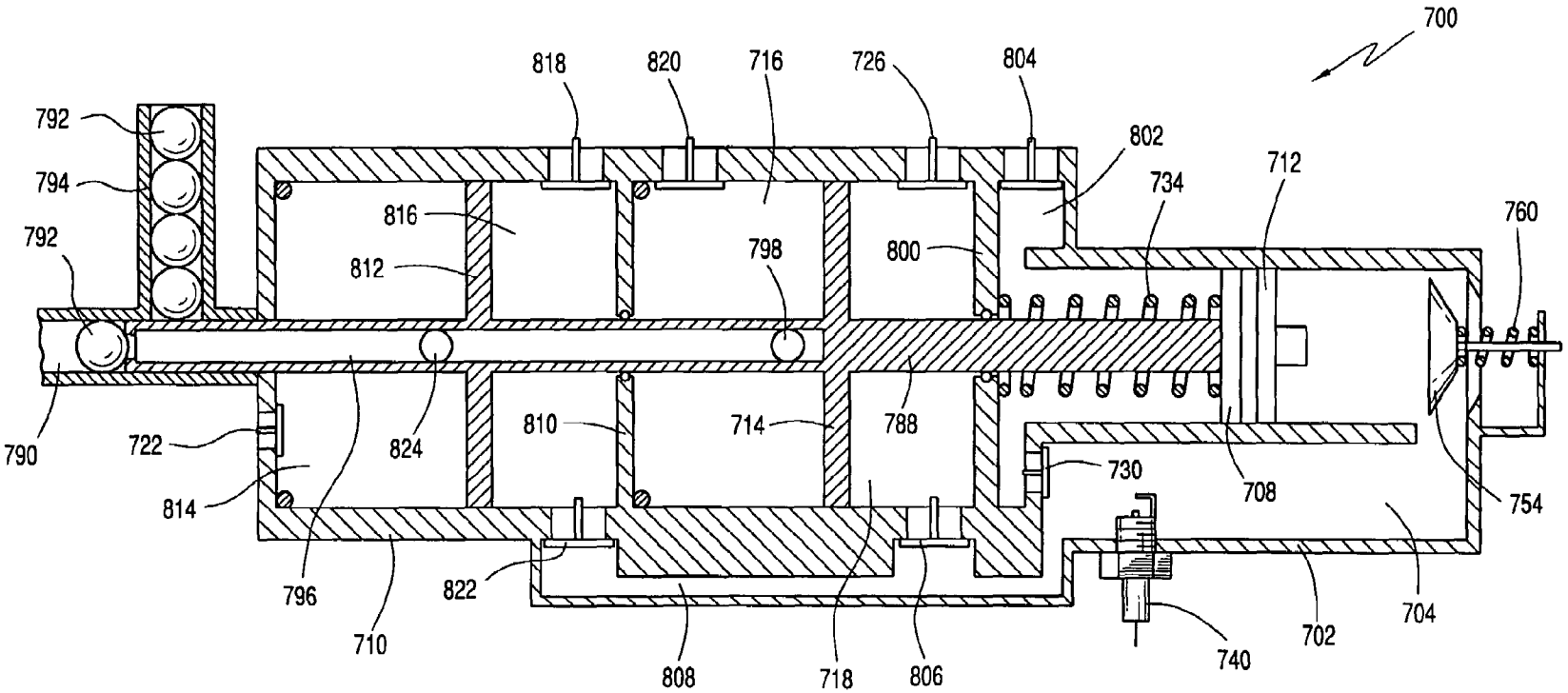
FIG. 13 is a schematic, cross-sectional view, similar to that of FIG. 12, showing, however, a sixth modified embodiment of the paintball marker tool wherein, in addition to the power piston performing a scavenging or purging operation during the power stroke portion of the overall combustion cycle, dual or tandem scavenging pistons perform a combustion product or exhaust gas scavenging or purging operation during the return stroke portion of the overall combustion cycle such that enhanced scavenging or purging may be achieved in connection with a larger combustion chamber such that the overall size of the tool may effectively be reduced and yet enhanced power may be derived therefrom.

Referring now to FIG. 13, there is disclosed a sixth embodiment of a new and improved combustion-powered linear air motor/compressor, as constructed in accordance with the principles and teachings of the present invention, which is effectively a modified embodiment of the paintball marker tool as disclosed within FIG. 12, and which is designated by means of the reference character 700. Accordingly, it is noted that in view of the basic structural similarities between the sixth embodiment combustion-powered linear air motor/compressor/paintball marker 700, as disclosed within FIG. 13, and the fifth embodiment combustion-powered linear air motor/compressor/paintball marker 500 as disclosed within FIG. 12, a detailed description of the sixth embodiment combustion-powered linear air motor/compressor/paintball marker 700 will be omitted herefrom for brevity purposes, the description of the same being confined to the differences between the fifth and sixth embodiment combustion-powered linear air motor/compressor/paintball markers 500,700.

In addition, it is also noted that component parts of the sixth embodiment combustion-powered linear air motor-compressor paintball marker 700 which correspond to component parts of the fifth embodiment combustion-powered linear air motor-compressor/paintball marker 500 will be designated by corresponding reference characters except that they will be within the 700 and 800 series. As can therefore be appreciated from FIG. 13, it is seen that in accordance with the structural features comprising the sixth embodiment combustion-powered linear air motor/compressor paintball marker 700, as compared to the structural features comprising the fifth embodiment combustion-powered linear air motor-compressor paintball marker 500 as disclosed within FIG. 12, several structural differences have been implemented into the sixth embodiment combustion-powered linear air motor-compressor paintball marker 700 whereby enhanced scavenging or purging of the residual combustion products or exhaust gases, outwardly from the combustion chamber 704, can be achieved.

More particularly, it is seen, for example, that in lieu of the second cylindrical housing 710 being effectively divided into a single compression chamber and a single scavenging chamber, the second cylindrical housing 710 is provided with a second partition or divider wall 810 which effectively divides the second cylindrical housing 710 into two chambers within which first and second scavenging pistons 714 and 812 are respectively disposed. Accordingly, it can be appreciated still further that the first scavenging piston 714 effectively divides the first chamber of the second cylindrical housing 710 into a first compression chamber 716 and a first scavenging chamber 718, while the second scavenging piston 812 effectively divides the second chamber of the second cylindrical housing 710 into a second compression chamber 814 and a second scavenging chamber 816.

In addition, it is also seen that a third scavenging air intake valve 818 is provided within a side wall portion of the second cylindrical housing 710 so as to permit fresh or ambient air to enter into the second scavenging chamber 816, and in a similar manner, a second working air intake valve 820 is provided within another side wall portion of the second cylindrical housing 710 so as to permit fresh or ambient air to enter into the second compression chamber 814. Still yet further, a third scavenging air outlet valve 822 is provided within a side wall portion of the second cylindrical housing 710 so as to permit scavenging or purging air from the second scavenging chamber 816 to be fluidically conducted into the conduit 808 which is fluidically connected to the combustion chamber 704. It is lastly noted that the hollow tubular portion 796 of the piston rod assembly 788 is provided with a second aperture or through-bore 824 so as to permit the working air, disposed within the second compression chamber 814, to be discharged therefrom.

In light of the foregoing structure, it is therefore to be appreciated that during, for example, a power stroke of the piston assembly 708, wherein the piston assembly 708 is moving toward the left as viewed within FIG. 13, working air will be forced out from the first and second compression chambers 716,814 through means of the apertures or through-bores 798,824 and the hollow tubular portion 796 of the piston rod assembly 788, and substantially simultaneously therewith, fresh or ambient scavenging air is ingested or inducted into the first and second scavenging chambers 718, 816 through means of the first and third scavenging air intake valves 726,818. In a similar manner, during, for example, a return stroke, wherein the piston assembly 708 is moving toward the right as viewed within FIG. 13, the fresh or ambient scavenging air disposed within the first and second scavenging chambers 718,816 will now be forcefully rammed into the combustion chamber 704 through means of the second and third scavenging air outlet valves 806,822 and the conduit 808 fluidically connecting the first and second scavenging chambers 718,816 to the combustion chamber 704. In addition, it is noted further that during the return stroke of the piston assembly 708, fresh or ambient scavenging air is also ingested or inducted into the ante-chamber 802 through means of the second scavenging air intake valve 804 whereupon, during the next power stroke of the piston assembly 708, the fresh or ambient scavenging air disposed within the antechamber 802 will be forcefully rammed into the combustion chamber 704 through means of the scavenging air outlet valve 730. It can therefore be appreciated that as a result of the particular structure characteristic of the sixth embodiment combustion-powered linear air motor-compressor paintball marker 700, not only does purging or scavenging of the residual combustion gases or exhaust products within the combustion chamber 704 occur during both the power and return strokes of the piston assembly 708 such that the overall scavenging or purging efficiency of the tool or implement 700 with respect to the residual combustion gases or exhaust products within the combustion chamber 704 can be enhanced, but in addition, as a result of the provision of the dual or tandem scavenging pistons 714,812 within the dual or tandem scavenging chambers 718,816, the size of the tool 700 may effectively be reduced in that a single, relatively large scavenging piston assembly is able to be replaced by means of a relatively smaller dual-scavenging piston assembly whereby the same or increased volume of scavenging air is nevertheless able to be generated. It is also noted that the dual-piston structure 714,812 comprising this embodiment of the combustion-powered linear air motor/compressor 700 can also be used within those embodiments of the combustion-powered linear air motor/compressors 100,200,300,400 wherein scavenging is not being performed during the power stroke of the power pistons 112,212,312,412.

Figure 14:
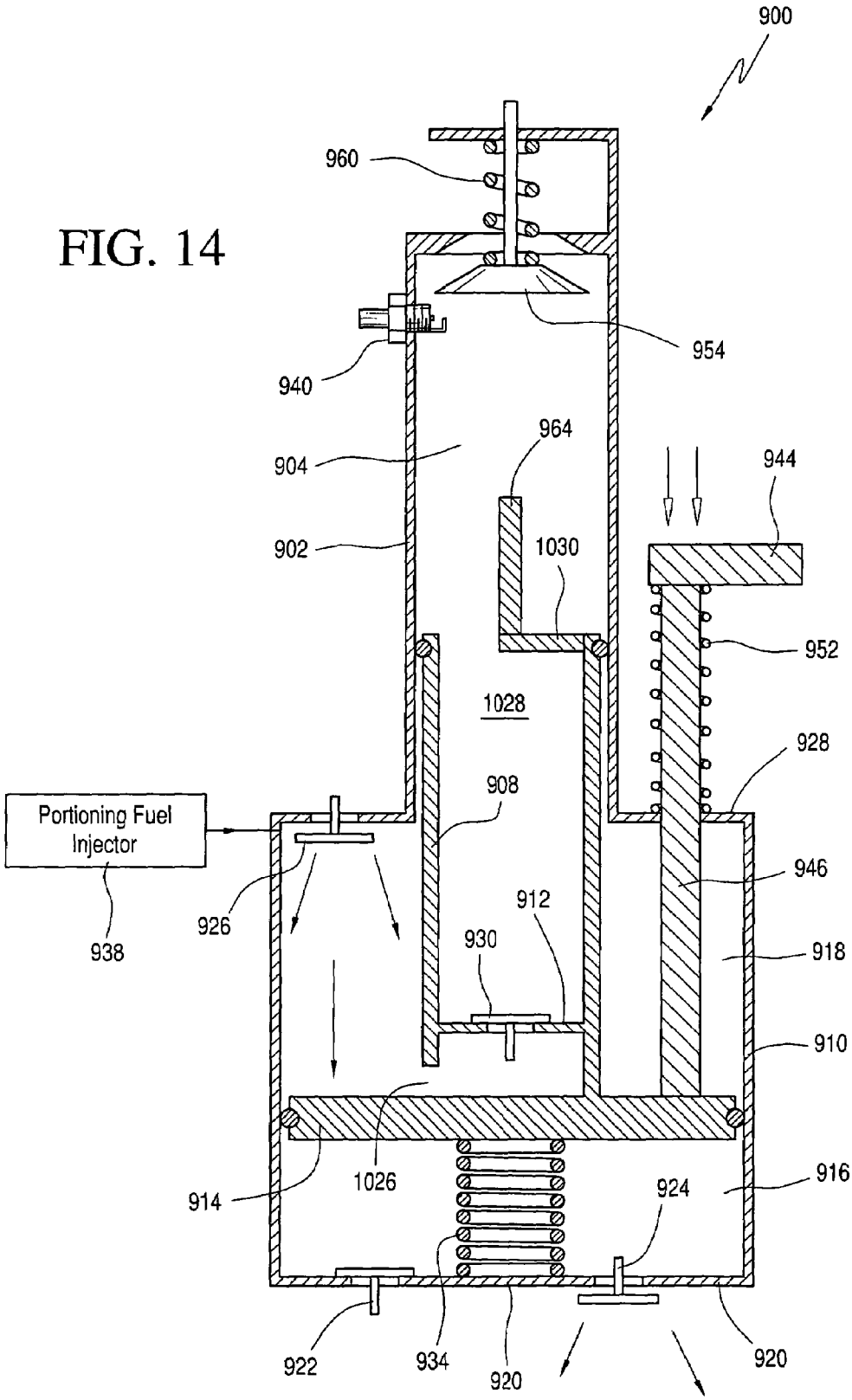
FIG. 14 is a schematic, cross-sectional view, similar to that of FIG. 2, showing, however, a seventh modified embodiment of the new and improved combustion-powered linear air motor/compressor, somewhat similar to the first embodiment combustion-powered linear air motor/compressor as disclosed within FIGS. 2-8, wherein, however, the combustion chamber of the device is coaxially disposed with respect to the compression and scavenging chambers of the device, and wherein further, scavenging of the residual combustion products or exhaust gases disposed directly above the power piston is facilitated.
Figure 15:
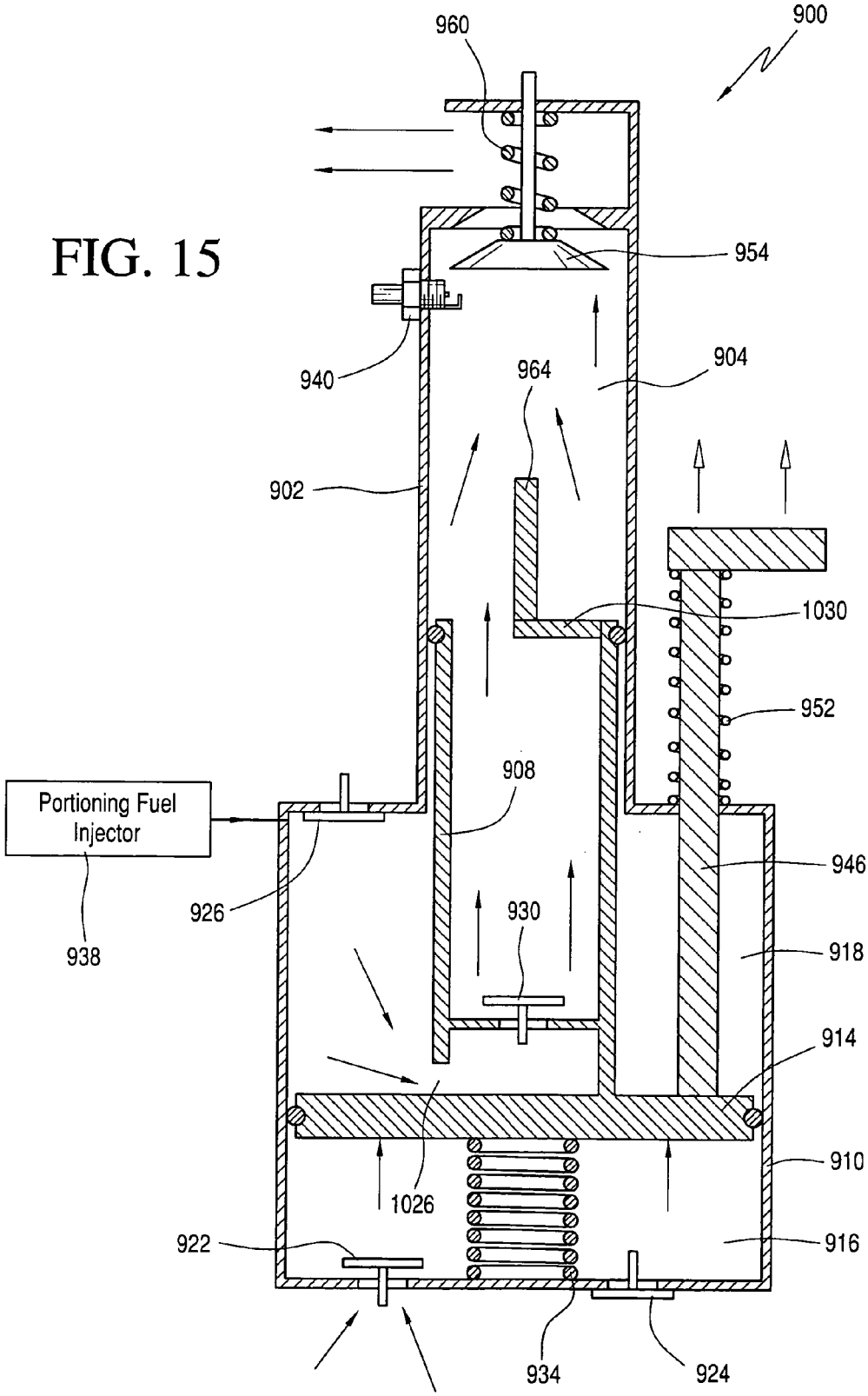
FIG. 15 is a schematic, cross-sectional view, similar to that of FIG. 14, showing, however, the manually-actuated starter plunger mechanism, and the piston assembly, being moved upwardly so as to be biased back toward their original START positions.

With reference now being made to FIGS. 14 and 15, there is disclosed a seventh embodiment of a new and improved combustion-powered linear air motor/compressor, as constructed in accordance with the principles and teachings of the present invention, which is designated by means of the reference character 900. Accordingly, it is noted that in view of the basic structural similarities between the seventh embodiment combustion-powered linear air motor-compressor 900, as disclosed within FIGS. 14 and 15, and the first embodiment combustion-powered linear air motor-compressor 100 as disclosed within FIGS. 2-8, a detailed description of the seventh embodiment combustion-powered linear air motor-compressor 900 will be omitted herefrom for brevity purposes, the description of the same being confined to the differences between the first and seventh embodiment combustion-powered linear air motor-compressors 100,700. In addition, it is also noted that component parts of the seventh embodiment combustion-powered linear air motor-compressor 900 which correspond to component parts of the first embodiment combustion-powered linear air motor-compressor 100 will be designated by corresponding reference characters except that they will be within the 900 and 1000 series. As can therefore be appreciated from FIG. 13, it is seen that in accordance with the structural features comprising the seventh embodiment combustion-powered linear air motor-compressor 900, as compared to the structural features comprising the first embodiment combustion-powered linear air motor-compressor 100 as disclosed within FIG. 2-8, several structural differences have been implemented into the seventh embodiment combustion-powered linear air motor-compressor 900 whereby not only can the size of the device or tool be relatively reduced, but in addition, enhanced scavenging or purging of the residual combustion products or exhaust gases, outwardly from the combustion chamber 704, can be achieved.

More particularly, it is initially to be appreciated that in accordance with the principles and teachings of the seventh embodiment combustion-powered linear air motor-compressor 900, the combustion chamber 904 is coaxially disposed with respect to the compression and scavenging chambers 916,918 whereby the overall width, or radial or diametrical, extent of the combustion chamber 904, and that of the overall tool 900, is able to be substantially reduced. In addition, it is seen that the scavenging piston 914 is a solid member, and that the return spring 934 is interposed between the end wall 920 of the second cylindrical housing 910 and the scavenging piston 914. Still further, the scavenging air outlet valve 930, in lieu of being mounted within the wall member separating the first and second cylindrical housings 902,910, is now mounted at an axially central portion of the power piston 912. Still yet further, it is also seen that a side wall portion of the piston assembly 908 has an aperture or passageway 1026 defined therein so as to fluidically connect the scavenging chamber 918 with the interior hollow portion 1028 of the piston assembly 908, and in addition, it is also seen that the lug member or stem 964 of the piston assembly 908 is fixedly mounted upon a spider-type structure 1030 that is fixedly mounted upon the upstream end portion of the piston assembly 908.

Accordingly, it can be readily appreciated that upon undergoing a downward power stroke, working air is discharged from the compression chamber 916 through means of the working air outlet valve 924, and at substantially the same time, ambient or fresh scavenging air is ingested or inducted into the scavenging chamber 918 through means of the scavenging air intake valve 926. As a result of, for example, the elevated pressure levels within the combustion chamber 904 during the combustion phase of the operational cycle, the scavenging air outlet valve 930, disposed upon the power piston 912, is maintained closed whereby the pressure forces developed during the combustion phase of the operational cycle act across the entire surface area of the power piston 912, including the face or surface area of the scavenging air outlet valve 930. During the upward return stroke of the piston assembly 908, working air will be ingested or inducted into the compression chamber 916 through means of the working air intake valve 922, and the fresh or ambient scavenging air, present within the scavenging chamber 918, will now be forced past the scavenging air outlet valve 930, into the hollow or tubular portion 1028 of the piston assembly 908, through the spider structure 1030, and into the combustion chamber 904. It can therefore be appreciated that enhanced scavenging or purging of the residual combustion products or exhaust gases is able to be achieved in view of the fact that not only is the space comprising the combustion chamber 904 scavenged or purged, but in addition, the space disposed directly above or upstream of the power piston 912 is likewise able to be flushed, purged, or scavenged.

Figure 16:
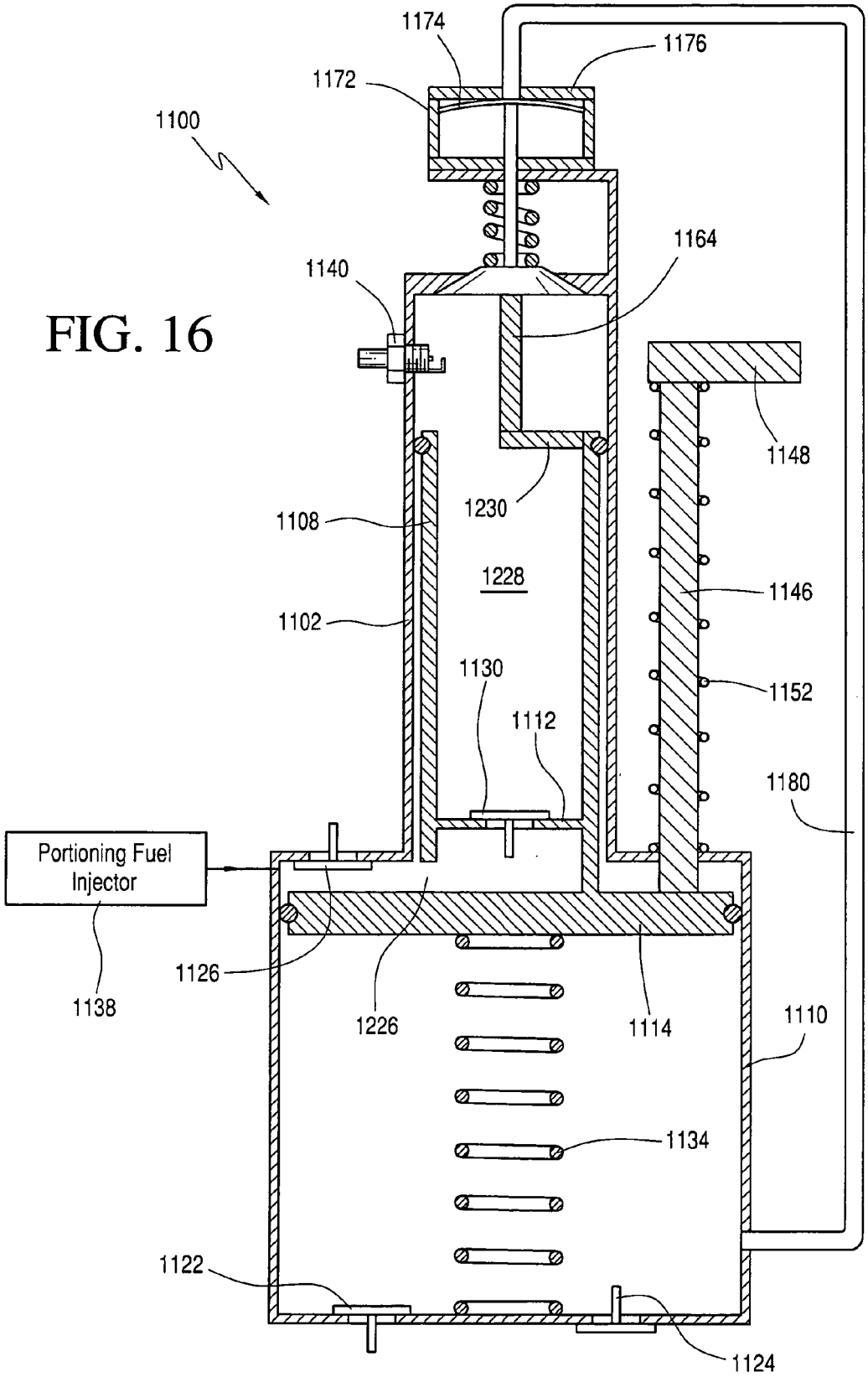
FIG. 16 is a schematic, cross-sectional view, similar to that of FIG. 14, showing, however, an eighth modified embodiment of the new and improved combustion-powered linear air motor/compressor wherein the manually-actuated starter plunger mechanism is disposed at its START position and the device comprises a fluidic signal line similar to that incorporated within the embodiment of FIG. 9.

With reference lastly being made to FIG. 16, there is disclosed an eighth embodiment of a new and improved combustion-powered linear air motor/compressor which is constructed in accordance with the principles and teachings of the present invention, which is, in effect, a modified embodiment of the combustion-powered linear air motor/compressor 900 as disclosed within FIGS. 14 and 15, and which is designated by means of the reference character 1100. Accordingly, in view of the basic structural similarities between the eighth embodiment combustion-powered linear air motor-compressor 1100, as disclosed within FIG. 16, and the seventh embodiment combustion-powered linear air motor-compressor 900 as disclosed within FIGS. 14 and 15, a detailed description of the eighth embodiment combustion-powered linear air motor-compressor 1100 will be omitted herefrom for brevity purposes, the description of the same being confined to the differences between the seventh and eighth embodiment combustion powered linear air motor-compressors 900,1100. In addition, it is also noted that component parts of the eighth embodiment combustion-powered linear air motor-compressor 1100 that correspond to component parts of the seventh embodiment combustion-powered linear air motor-compressor 900 will be designated by corresponding reference characters except that they will be within the 1100 and 1200 series. More particularly, the only significant difference between the eighth embodiment combustion-powered linear air motor-compressor 1100 and the seventh embodiment combustion-powered linear air motor-compressor 900 resides in the fact that a fluidic signal line 1180 and a diaphragm member 1174, similar to the fluidic signal line 280 and the diaphragm member 274 of the second embodiment combustion-powered linear air motor-compressor 200, as disclosed within FIG. 9, has effectively been incorporated into the seventh embodiment combustion-powered linear air motor-compressor 900 so as to structurally achieve the eighth embodiment combustion-powered linear air motor-compressor 1100.

Thus, it may be seen that in accordance with the principles and teachings of the present invention, there has been disclosed various embodiments of a new and improved combustion-powered linear air motor/compressor wherein the new and improved combustion-powered linear air motor/compressor comprises new and improved structure for achieving the scavenging of residual combustion products or exhaust gases from the combustion chamber during the return stroke of the power piston assembly. More particularly, the speed and efficiency of the scavenging of the residual combustion products or exhaust gases is able to be achieved as a result of a scavenging piston of the piston assembly causing fresh or ambient air to be rammed or forced into, through, and out of the combustion chamber during the return stroke of the power piston assembly. In addition, a power piston of the piston assembly may also cause fresh or ambient air to be rammed or forced into, through, and out of the combustion chamber during the power stroke of the power piston.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A combustion-powered motor/compressor, comprising:

a first housing;

a combustion chamber defined within said first housing;

means for charging an air/fuel mixture into said combustion chamber;

ignition means disposed within said combustion chamber so as to initiate combustion of said air/fuel mixture within said combustion chamber;

a power piston movably disposed within said combustion chamber so as to undergo a power stroke, as a result of said combustion of said air/fuel mixture within said combustion chamber, from a START position to an END position, and a return stroke from said END position back to said START position;

an exhaust valve fluidically connected to said combustion chamber;

means for moving said exhaust valve to an OPEN position during said return stroke of said power piston so as permit scavenging of exhaust combustion products out from said combustion chamber during said return stroke of said power piston, and for causing said exhaust valve to be moved to a CLOSED position when said power piston has returned to said START position so as to close said combustion chamber and thereby house a fresh air/fuel mixture within said combustion chamber for subsequent ignition and a new power stroke of said power piston;

a second housing connected to said first housing by means of a first end wall; and a scavenging piston operatively connected to said power piston so as to form a piston assembly therewith and which is movably disposed within said second housing so as to effectively divide said second housing into a compression chamber, from which working air is adapted to be discharged by said scavenging piston during said power stroke of said power piston, and a scavenging chamber, fluidically connected to said combustion chamber, from which fresh scavenging air is adapted to be forcefully discharged, by said scavenging piston, into said combustion chamber during said return stroke of said power piston.

2. The combustion-powered motor/compressor as set forth in claim 1, further comprising:

a manually-operated starter plunger mechanism operatively connected to said piston assembly for initially moving said piston assembly from said START position to said END position and back to said START position in order to provide said combustion chamber with an initial charge of fresh scavenging air in order to initiate a combustion cycle.

3. The combustion-powered motor/compressor as set forth in claim 1, further comprising:

working air intake and outlet valves operatively connected to said compression chamber of said second housing for respectively permitting working air to be ingested into said compression chamber of said second housing during said return stroke of said power piston, and for discharging said working air out from said compression chamber of said second housing during said power stroke of said power piston;

scavenging air intake and outlet valves operatively connected to said scavenging chamber of said second housing for respectively permitting scavenging air to be ingested into said scavenging chamber of said second housing during said power stroke of said power piston, and for discharging said scavenging air out from said scavenging chamber of said second housing and into said combustion chamber during said return stroke of said power piston.

4. The combustion-powered motor/compressor as set forth in claim 1, further comprising:

a return spring interposed between a second end wall of said second housing and said piston assembly for returning said piston assembly to said START position.

5. The combustion-powered motor/compressor as set forth in claim 1, further comprising:

diaphragm means operatively connected to said exhaust valve disposed within said combustion chamber for assisting movement of said exhaust valve from said CLOSED position to an OPEN position as a function of pressure levels within said compression chamber; and a fluidic signal line fluidically connecting said compression chamber to said diaphragm means for conveying a pressure signal to said diaphragm means.

6. The combustion-powered motor/compressor as set forth in claim 1, further comprising:

fan means operatively associated with said first and second housings for cooling said first and second housings with respect to heat generated within said combustion chamber as a result of combustion within said combustion chamber; and a thermally-activated switch mechanism mounted upon an external wall portion of said first housing for activating said fan means in response to predeterminedly sensed temperature levels.

7. The combustion-powered motor/compressor as set forth in claim 1, further comprising:

a piston rod assembly operatively connected to said piston assembly;

wherein said piston rod assembly comprises a hollow tubular portion for discharging said working air out from said compression chamber, and a through-bore defined within said hollow tubular portion of said piston rod assembly for fluidically connecting said hollow tubular portion of said piston rod assembly to said compression chamber of said second housing.

8. The combustion-powered motor/compressor as set forth in claim 7, wherein:

said combustion-powered motor/compressor is incorporated within a paintball marker wherein said working air, discharged from said compression chamber through means of said through-bore and said hollow tubular portion of said piston rod assembly, will launch paintballs from said paintball marker.

9. The combustion-powered motor/compressor as set forth in claim 1, further comprising:

a divider wall fixedly mounted internally within said second housing and spaced from said first end wall so as to cooperate with said first end wall in defining an antechamber therebetween from which fresh scavenging air, in addition to being discharged from said scavenging chamber and into said combustion chamber during said return stroke of said power piston, can also be discharged into said combustion chamber during said power stroke of said power piston.

10. The combustion-powered motor/compressor as set forth in claim 9, further comprising:

first scavenging air intake and outlet valves operatively connected to said scavenging chamber of said second housing for respectively permitting scavenging air to be ingested into said scavenging chamber of said second housing during said power stroke of said power piston, and for discharging said scavenging air out from said scavenging chamber of said second housing and into said combustion chamber during said return stroke of said power piston;

second scavenging air intake and outlet valves operatively connected to said antechamber of said second housing for respectively permitting scavenging air to be ingested into said antechamber of said second housing during said return stroke of said power piston, and for discharging said scavenging air out from said antechamber of said second housing and into said combustion chamber during said power stroke of said power piston.

11. The combustion-powered motor/compressor as set forth in claim 10, further comprising:

a fluid conduit fluidically connecting said scavenging chamber of said second housing to said combustion chamber.

12. The combustion-powered motor/compressor as set forth in claim 9, further comprising:

a return spring interposed between said divider wall and said power piston of said piston assembly for returning said piston assembly to said START position.

13. The combustion-powered motor/compressor as set forth in claim 9, further comprising:

a second divider wall fixedly mounted internally within said second housing and spaced from said first divider wall so as to divide said second housing into a pair of chambers, wherein said scavenging piston is disposed within a first one of said pair of chambers so as to effectively divide said first chamber into a first compression chamber, from which working air is adapted to be discharged by said scavenging piston during said power stroke of said power piston, and a first scavenging chamber, fluidically connected to said combustion chamber, from which fresh scavenging air is adapted to be forcefully discharged, by said scavenging piston, into said combustion chamber during said return stroke of said power piston, while a second scavenging piston is disposed within a second one of said pair of chambers so as to effectively divide said second chamber into a second compression chamber, from which working air is adapted to be discharged by said second scavenging piston during said power stroke of said power piston, and a second scavenging chamber, fluidically connected to said combustion chamber, from which fresh scavenging air is adapted to be forcefully discharged, by said second scavenging piston, into said combustion chamber during said return stroke of said power piston.

14. The combustion-powered motor/compressor as set forth in claim 13, further comprising:

first scavenging air intake and outlet valves operatively connected to said first scavenging chamber of said second housing for respectively permitting scavenging air to be ingested into said first scavenging chamber of said second housing during said power stroke of said power piston, and for discharging said scavenging air out from said first scavenging chamber of said second housing and into said combustion chamber during said return stroke of said power piston;

second scavenging air intake and outlet valves operatively connected to said second scavenging chamber of said second housing for respectively permitting scavenging air to be ingested into said second scavenging chamber of said second housing during said return stroke of said power piston, and for discharging said scavenging air out from said second scavenging chamber of said second housing and into said combustion chamber during said power stroke of said power piston; and third scavenging air intake and outlet valves operatively connected to said antechamber of said second housing for respectively permitting scavenging air to be ingested into said antechamber of said second housing during said return stroke of said power piston, and for discharging said scavenging air out from said antechamber of said second housing and into said combustion chamber during said power stroke of said power piston.

15. The combustion-powered motor/compressor as set forth in claim 14, further comprising:

a fluid conduit fluidically connecting said first and second scavenging chambers of said second housing to said combustion chamber.

16. The combustion-powered motor/compressor as set forth in claim 1, further comprising:

a divider wall fixedly mounted internally within said second housing and spaced from said first end wall so as to divide said second housing into a pair of chambers; and a pair of scavenging pistons movably disposed respectively within said pair of chambers whereby a first one of said pair of scavenging pistons is disposed within a first one of said pair of chambers so as to effectively divide said first chamber into a first compression chamber, from which working air is adapted to be discharged by said scavenging piston during said power stroke of said power piston, and a first scavenging chamber, fluidically connected to said combustion chamber, from which fresh scavenging air is adapted to be forcefully discharged, by said first scavenging piston, into said combustion chamber during said return stroke of said power piston, while a second one of said pair of scavenging pistons is disposed within a second one of said pair of chambers so as to effectively divide said second chamber into a second compression chamber, from which working air is adapted to be discharged by said second scavenging piston during said power stroke of said power piston, and a second scavenging chamber, fluidically connected to said combustion chamber, from which fresh scavenging air is adapted to be forcefully discharged, by said second scavenging piston, into said combustion chamber during said return stroke of said power piston.

17. The combustion-powered motor/compressor as set forth in claim 16, further comprising:

first scavenging air intake and outlet valves operatively connected to said first scavenging chamber of said second housing for respectively permitting scavenging air to be ingested into said first scavenging chamber of said second housing during said power stroke of said power piston, and for discharging said scavenging air out from said first scavenging chamber of said second housing and into said combustion chamber during said return stroke of said power piston; and second scavenging air intake and outlet valves operatively connected to said second scavenging chamber of said second housing for respectively permitting scavenging air to be ingested into said second scavenging chamber of said second housing during said return stroke of said power piston, and for discharging said scavenging air out from said second scavenging chamber of said second housing and into said combustion chamber during said power stroke of said power piston.

18. The combustion-powered motor/compressor as set forth in claim 17, further comprising:

a fluid conduit fluidically connecting said first and second scavenging chambers of said second housing to said combustion chamber.

19. The combustion-powered motor/compressor as set forth in claim 1, wherein:

said combustion chamber is coaxially aligned with respect to said second housing within which said scavenging piston is disposed.

20. The combustion-powered motor/compressor as set forth in claim 19, further comprising:

a return spring interposed between a second end wall of said second housing and said scavenging piston for for returning said piston assembly to said START position.

21. The combustion-powered motor/compressor as set forth in claim 19, wherein:

said power piston is disposed within a hollow portion of said piston assembly;

a scavenging air intake valve is operatively connected to said scavenging chamber of said second housing for permitting scavenging air to be ingested into said scavenging chamber of said second housing during said power stroke of said power piston; and a scavenging air outlet valve is operatively mounted upon said power piston for discharging said scavenging air out from said scavenging chamber of said second housing, through said hollow portion of said piston assembly, and into said combustion chamber during said return stroke of said power piston.

22. The combustion-powered motor/compressor as set forth in claim 1, wherein said means for moving said exhaust valve to said OPEN position during said return stroke of said power piston, so as permit scavenging of exhaust combustion products out from said combustion chamber during said return stroke of said power piston, and for causing said exhaust valve to be moved to a CLOSED position when said power piston has returned to said START position so as to close said combustion chamber and thereby house a fresh air/fuel mixture within said combustion chamber for subsequent ignition and a new power stroke of said power piston, comprises:

a first spring operatively associated with said exhaust valve and exerting a biasing force upon said exhaust valve so as to move said exhaust valve to said OPEN position as a result of pressure levels within said combustion chamber having been reduced at the end of said power stroke; and a second return spring operatively connected to said power piston for returning said power piston to said START position so as to engage said exhaust valve and move said exhaust valve to said CLOSED position against said biasing force of said first spring.

* * * * *